US008137477B2

(12) United States Patent
Wittorff et al.

(10) Patent No.: US 8,137,477 B2
(45) Date of Patent: Mar. 20, 2012

(54) METHOD OF CLEANING A SURFACE ATTACHED WITH AT LEAST ONE CHEWING GUM LUMP

(75) Inventors: Helle Wittorff, Vejle Øst (DK); Jesper Neergaard, Århus C (DK)

(73) Assignee: Gumlink A/S (DK)

( * ) Notice: Subject to any disclaimer, the term of this patent is extended or adjusted under 35 U.S.C. 154(b) by 648 days.

(21) Appl. No.: 11/887,043

(22) PCT Filed: Mar. 22, 2005

(86) PCT No.: PCT/DK2005/000200

§ 371 (c)(1),
(2), (4) Date: Sep. 24, 2007

(87) PCT Pub. No.: WO2006/099866

PCT Pub. Date: Sep. 28, 2006

(65) Prior Publication Data

US 2009/0203564 A1 Aug. 13, 2009

(51) Int. Cl.
*B08B 7/00* (2006.01)

(52) U.S. Cl. ..... 134/40; 134/42

(58) Field of Classification Search ..... 134/40, 134/34, 36, 39, 25.2, 26, 30, 42; 426/3; 510/320, 510/392, 530

See application file for complete search history.

(56) References Cited

U.S. PATENT DOCUMENTS

| | | | | |
|---|---|---|---|---|
| 2,607,359 | A | 8/1952 | Oesting | |
| 4,067,773 | A | 1/1978 | Martin | |
| 4,405,647 | A | 9/1983 | Fisher et al. | |
| 4,753,805 | A | 6/1988 | Cherukuri et al. | |
| 4,968,511 | A | 11/1990 | D'Amelia et al. | |
| 5,672,367 | A | 9/1997 | Grijpma | |
| 5,858,117 | A * | 1/1999 | Oakes et al. | 134/27 |
| 5,866,179 | A | 2/1999 | Testa | |
| 5,880,080 | A * | 3/1999 | Amory et al. | 510/320 |
| 5,976,581 | A | 11/1999 | Song et al. | |
| 6,017,565 | A | 1/2000 | Rancich et al. | |
| 6,322,828 | B1 | 11/2001 | Athanikar et al. | |
| 6,323,007 | B1 * | 11/2001 | Moller et al. | 435/74 |

(Continued)

FOREIGN PATENT DOCUMENTS

JP 19979957 A 1/1997

(Continued)

OTHER PUBLICATIONS

Booma, M. et al., "Degradable Plastics"; Journal of Elastomers and Plastics, vol. 26, No. 104; Apr. 1994; 40 pages.

(Continued)

*Primary Examiner* — Alexander Markoff
(74) *Attorney, Agent, or Firm* — St. Onge Steward Johnston & Reens LLC

(57) ABSTRACT

The invention relates to a method of cleaning a surface (1) attached with at least one chewing gum lump (2) whereby said cleaning is at least partly based on an enzymatic degradation of at least one biodegradable polymer in said chewing gum lump (2) and whereby said enzymatic degradation is initiated by the application of at least one enzyme to which said at least one polymer forms substrate and whereby said at least one enzyme is added to said chewing gum lump (2) subsequent to chewing and attachment of said chewing gum lump (2) to said surface (1).

65 Claims, 3 Drawing Sheets

U.S. PATENT DOCUMENTS

Figure 1A:
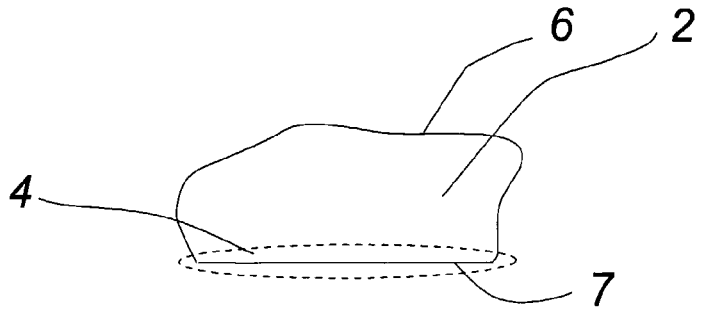

| | | | | |
|---|---|---|---|---|
| 6,376,450 | B1 * | 4/2002 | Ghosh et al. | 510/392 |
| 6,818,236 | B2 | 11/2004 | Hill et al. | |
| 6,824,623 | B1 * | 11/2004 | Gross et al. | 134/36 |
| 6,982,244 | B2 * | 1/2006 | Gross et al. | 510/365 |
| 2002/0009436 | A1 * | 1/2002 | Doyle et al. | 424/94.6 |
| 2004/0115305 | A1 * | 6/2004 | Andersen et al. | 426/3 |
| 2004/0142066 | A1 * | 7/2004 | Andersen et al. | 426/3 |
| 2004/0146599 | A1 * | 7/2004 | Andersen et al. | 426/3 |
| 2004/0156949 | A1 * | 8/2004 | Andersen et al. | 426/3 |
| 2005/0032670 | A1 | 2/2005 | Besseling | |
| 2007/0154591 | A1 * | 7/2007 | Andersen | 426/3 |

FOREIGN PATENT DOCUMENTS

| | | | |
|---|---|---|---|
| WO | WO 97/21424 | | 6/1997 |
| WO | WO 02/076227 | A1 | 10/2002 |
| WO | WO 02/076228 | A1 | 10/2002 |
| WO | WO 02/076229 | A1 | 10/2002 |
| WO | WO 02/076230 | A1 | 10/2002 |
| WO | WO 02/076231 | A1 | 10/2002 |
| WO | WO 2004/004480 | A1 | 1/2004 |
| WO | WO 2004/028265 | A1 | 4/2004 |
| WO | WO 2004/028266 | A1 | 4/2004 |
| WO | WO 2004/028267 | A1 | 4/2004 |
| WO | WO 2004/028268 | A1 | 4/2004 |
| WO | WO 2004/028269 | A1 | 4/2004 |
| WO | WO 2004/028270 | A1 | 4/2004 |
| WO | WO 2004/068964 | A1 | 8/2004 |
| WO | WO 2005/063037 | A1 | 7/2005 |
| WO | WO 2005063037 | A1 * | 7/2005 |

OTHER PUBLICATIONS

Notice of Opposition & Grounds of Opposition prepared by Mr. Colm Murphy; Application No. 05715121.9; May 13, 2009; 15 pages.

International Search Report; International Application No. PCT/DK2005/000200; Date of the actual completion of the international search Nov. 9, 2005; Date of mailing of the international search report Nov. 18, 2005 (3 pages).

EP0513978; Nov. 19, 1992; Abstract Only (1 page).

WO8603967; Jul. 17, 1987; Abstract Only (1 page).

EP0890358; Jan. 13, 1999; Abstract Only (1 page).

DE19751330; May 20, 1999; Abstract Only (1 page).

* cited by examiner

METHOD OF CLEANING A SURFACE ATTACHED WITH AT LEAST ONE CHEWING GUM LUMP

FIELD OF THE INVENTION

The invention relates to a method of removing a chewing gum lump completely or partly from a surface.

BACKGROUND OF THE INVENTION

It is generally recognized that chewing gum that is dropped in indoor or outdoor environments gives rise to considerable nuisances and inconveniences due to the fact that the dropped gum sticks firmly to e.g. street and pavement surfaces and to shoes and clothes of people being present or moving in the environments. Adding substantially to such nuisances and inconveniences is the fact that currently available chewing gum products are based on the use of elastomeric and resinous polymers of natural or synthetic origin that are substantially non-degradable in the environment.

City authorities and others being responsible for cleanliness of indoor and outdoor environments therefore have to exercise considerable efforts to remove dropped chewing gum, such efforts, however, being both costly and without satisfactory results.

Attempts have been made to reduce the nuisances associated with the widespread use of chewing gum, e.g. by improving cleaning methods to make them more effective with regard to removal of dropped chewing gum remnants or by incorporating anti-sticking agents into chewing gum formulations. However, none of these precautions, which follows mainly two paths, namely either improving the methods of cleaning the chewing gum from a surface or either preparing a chewing gum having non-tack properties, have contributed significantly to solving the pollution problem.

A cleaning agent and a method related to the use of this agent according to the first path are disclosed in US patent application no. 2005/0032670. According to this document and other related methods, a change of consistence of the polluting chewing gum is obtained by means of e.g. steam supplied with chemical reactive agents. A problem related to these post-processing techniques is generally that chewing gum residues are typically accepted.

Several attempt have been made following the second path, namely basically that of avoiding the sticking of chewing gum lump to surfaces. The past two decades have seen an increasing amount of interest paid to synthetic polyesters for a variety of applications ranging from biomedical devices to gum bases. Many of these polymers are readily hydrolyzed to their monomeric hydroxy-acids, which are easily removed by metabolic pathways. Biodegradable polymers are e.g. anticipated as alternatives to traditional non- or low-degradable plastics such as poly(styrene), poly(isobutylene), SBR, and poly(methyl-methacrylate).

Thus, it has recently been disclosed, e.g. in U.S. Pat. No. 5,672,367, that chewing gum may be made from certain synthetic polymers having in their polymer chains chemically unstable bonds that can be broken under the influence of light or hydrolytically into water-soluble and non-toxic components. The document discloses that the nature of the applied polymers results in a reduced adhesion to surfaces.

The same approach in a slightly other direction has been made in U.S. Pat. No. 6,818,236 where a styrene-butadiene rubber is applied in chewing gum and where the disclosed rubber degrades and becomes brittle upon exposure to ultraviolet light (such as sunlight), ozone, heat, and other environmental chemicals.

A problem generally related the second path is that sticking to surfaces of the final chewed chewing gum lumps is hard to avoid without compromising the textural properties of the chewing gum during use.

A problem is however that the expected non-tack properties of so-called biodegradable chewing gum may be present under some conditions for some types of chewing gum, but that the general approach that biodegradable chewing gum has non-tack properties does not apply.

SUMMARY OF THE INVENTION

The invention relates to a method of cleaning a surface (1) attached with at least one chewing gum lump (2) whereby said cleaning is at least partly based on an enzymatic degradation of at least one biodegradable polymer in said chewing gum lump (2) and whereby said enzymatic degradation is established by the application of at least one enzyme to which said at least one polymer forms substrate and whereby said at least one enzyme is added to said chewing gum lump (2) subsequent to chewing and attachment of said chewing gum lump (2) to said surface (1).

It is noted that the term cleaning should be understood as a relative term, i.e. in the sense that cleaning may both mean a total removal or releasing of a chewing gum lump from a surface or at least a partly removal or diminishing of a chewing gum lump from a surface.

A further advantage of the invention is that cleaning of surfaces with respect to chewing gum may be performed with cleaning agents quite lenient to the surface compared to cleaning performed to conventional cleaning methods. Enzyme based cleaning agent is thus very lenient to e.g. terrazzo, marble or other types of surfaces, which may typically be very difficult to clean.

Moreover, when applying an enzyme based cleaning agent, remains of the applied agents may typically be regarded as very friendly to the environment in the sense that non-toxic enzymes are well-fitted for the purpose.

Evidently, the terminology related to the so-called intermolecular forces in this context refers to the overall intermolecular forces resulting in that the chewing gum lump is fastened to the surface. The intermolecular forces may thus e.g. comprise cohesive and/or adhesive forces or e.g. mechanically fastening resulting from that a part of the chewing gum lump has floated into cavities or openings of surface and thereby establishing a mechanical lock.

According to an embodiment of the invention, enzymatic influences may result in a partial disintegration and a crumbly structure of the lump thereby releasing the lump forming ingredients from the surface. Another example within the scope of the invention is when the chewing gum lump changes its structure due to enzymatic influence and where experiments have shown that the chewing gum lump when some conditions are fulfilled releases from surfaces to which the lump is attached, e.g. by adhering. In other words, the desired release from the surface may be obtained even without any visual disintegration of the lump. Herein the term attachment is used to represent both physical and chemical adhesion, and the intermolecular adhesion and/or attraction forces between chewing gum lump and surface.

The desired release may according to a preferred embodiment of the invention be obtained as a result of degradation of biodegradable polymers in the chewing gum lump. According to the invention, the degradation may be accelerated by addition of enzymes to the chewing gum lump by application of an enzyme-containing cleaning agent. Enzymes from the cleaning agent may initiate and catalyze the degradation process of the biodegradable polymers in the chewing gum lump and thereby accelerate the process of cleaning off the chewing gum lump from the surface.

In an embodiment of the invention, said enzymatic degradation is supplemented by a further enzymatic degradation obtained through enzymes present in the chewing gum lump (2) during chewing.

In an embodiment of the invention, said chewing gum lump (2) is attached to said surface (1) by means of intermolecular forces in a contact area (7), said chewing gum lump (2) comprising at least one biodegradable polymer, said biodegradable polymer having unstable bonds and forming substrate to at least one enzyme, reducing the intermolecular forces in an interface region (4) by modifying the structure of the molecular chains of said polymer by the process of providing a cleaning agent (3) to a free surface (6) of said chewing gum lump (2), said cleaning agent (3) comprising enzymes to which said biodegradable polymer forms substrate.

According to the invention, an improved release of chewing gum from a surface during cleaning is obtained due to the application of enzymes for at least partly degradation of polymer chains in the chewing gum.

According to the invention, sticking is counteracted by means of an agent, which is provided to the part of the chewing gum not sticking to the surface, i.e. not forming a part of the contact area. In other words, the desired effect is obtained through a reaction or a transport through/in the chewing gum from the not attached part of the chewing gum lump to the attached part.

According to the invention, it is possible to activate applied enzymes at a specific time, namely at the specific time of cleaning, thereby reducing premature degradation related to the function and effect of enzymes of the chewing gum partly or even completely. In particular, such activation may advantageously be performed if the applied enzymes comprise proenzymes, which may be activated conveniently subsequent to termination of the chewing process applied for the establishment of the relevant chewing gum lump.

Furthermore, the invention facilitates that accelerated degradation or transformation processes of a chewing gum lump may be avoided prior to or during chewing due to the fact that the main reaction within the chewing gum lump is delayed to a time where the consumer is no longer affected by the desired reactions in the chewing gum lump. Thus undesired effects of enzymatic degradation such as taste or complicated approval procedures may be avoided.

In other words, the invention benefits from the realization that a chewing gum lump may change significantly over time when comprising a biodegradable polymer and that this change of state may be applied for obtaining a non-tack or at least partly releasing of a chewing gum from a surface in spite of the fact that the chewing gum lump initially inherits sticking properties.

In an embodiment of the invention, said cleaning agent comprises at least one enzyme in a liquid suspension or solution.

In an embodiment of the invention, said cleaning agent comprises enzymes in a solid state or mixture.

Finally, it should be noted that the cleaning agent may comprise a cleaning agent comprising enzyme(s), where both the cleaning agent and/or the enzyme are present in a solid state. Typically, the desired initiation of degradation may however be accelerated by a liquid, such as water, by active or passive adding. Passive adding may e.g. simply be obtained in outdoor environments if it is raining.

In an embodiment of the invention, said cleaning agent comprises at least one enzyme mixed in water.

The mixture may both comprise a suspension or a solution of the enzyme in a liquid and the liquid is preferably water as water itself may have a positive impact on the desired degradation of the polymer chains of the targeted chewing gum, as water itself may form the required reagent with respect to e.g. a hydrolytically degradation of a polymer. Moreover, water itself may, of course, be regarded environmentally compatible even if residues may remain after complete degradation.

In an embodiment of the invention, the concentration of said enzymes is in the range of 0.0001 wt % to 70 wt % of the cleaning agent.

In an embodiment of the invention, the concentration of said enzymes is in the range of 0.0002 wt % to 10 wt % of the cleaning agent.

In an embodiment of the invention, the concentration of said enzymes is in the range of 0.0003 wt % to 5 wt % of the cleaning agent.

In an embodiment of the invention, the at least two enzymes of said cleaning agent have different active areas with respect to temperature and/or pH.

Moreover, a significant advantage may be obtained when applying at least two different enzymes due to the fact that the enzymes may be chosen to supplement each other with respect to e.g. the pH- and temperature-intervals in which they are active. In other words, a cleaning agent may be obtained having high activity with respect to the substrate polymer of the chewing gum within a relatively large temperature and pH interval. Thus, the desired acceleration of degradation may be obtained in larger intervals of e.g. temperature and pH compared to what may be obtained e.g. by one single enzyme only.

In an embodiment of the invention, the active range of said cleaning agent with respect to temperature or pH is obtained by different enzymes having different active ranges.

Active range may be regarded as an interval e.g. with respect to temperature or pH within which a single enzyme has its main effect. Thus, as a specific example, if one enzyme is active or has its main effect within 0° C. to 15° C., a combined optimized effect of the cleaning agent may be obtained by adding a further enzyme having its main effect within e.g. 13° C. to 35° C., thereby increasing the active range of the cleaning agent to about 0° C. to 35° C. Such effect may be obtained correspondingly with respect to temperature, thereby increasing the temperature range within which the cleaning agent may be expected to have an accelerating effect on the biodegradation of the biodegradable polymers.

In an embodiment of the invention, the free surface (6) comprises a part of the surface of the chewing gum, which is not sticking to the surface (1).

In an embodiment of the invention, said reducing of the intermolecular forces involves a complete or at least partly dissolving of the chewing gum lump (2).

In an embodiment of the invention, said reducing of the intermolecular forces involves a complete or at least partly dissolving of the chewing gum lump (2) forming the contact area (7) of the chewing gum (2).

In an embodiment of the invention, said at least one biodegradable polymer is substantially hydrophilic.

In an embodiment of the invention, said chewing gum lump (2) is substantially free of non-biodegradable polymers.

In an embodiment of the invention, said polymer comprises an elastomer

In an embodiment of the invention, at least one of said at least one biodegradable polymer comprises at least one polyester polymer obtainable by polymerization of at least one cyclic ester.

In an embodiment of the invention, at least one of said at least one biodegradable polymer comprises at least one polyester polymer obtainable by condensation polymerization of at least one polyfunctional alcohol or derivative thereof and at least one polyfunctional acid or derivative thereof.

In an embodiment of the invention, at least one of said at least orie biodegradable polymer comprises at least one polyester obtainable by polymerization of at least one compound selected from the group of cyclic esters, alcohols or derivatives thereof and carboxylic acids or derivatives thereof.

In an embodiment of the invention, at least one of said at least one polyfunctional alcohol is a polyhydroxy alkyl alcohol.

In an embodiment of the invention, said derivative of said at least one polyfunctional alcohol comprises an ester of an alcohol.

In an embodiment of the invention, at least one of said at least one polyfunctional acid is a hydroxycarboxylic acid.

In an embodiment of the invention, at least one of said at least one polyfunctional acid is an α-hydroxy acid selected from the group of lactic acids and glycolic acids.

In an embodiment of the invention, said derivative of said at least one polyfunctional acid is selected from the group of esters, anhydrides or halides of carboxylic acids.

In an embodiment of the invention, said derivative of said at least one polyfunctional acid is selected from methyl esters or ethyl esters of carboxylic acids.

In an embodiment of the invention, said polyester is obtainable through reaction of at least one acid or derivative thereof selected from the group of terephthalic, phthalic, adipic, pimelic, succinic, malonic acids or combinations thereof with at least one alcohol or derivative thereof selected from the groups of methylene, ethylene, propylene, butylene diols or combinations thereof.

In an embodiment of the invention, at least one of said at least one cyclic ester is selected from the group of monomers comprising glycolides, lactides, lactones, cyclic carbonates or mixtures thereof.

In an embodiment of the invention, at least one of said lactone monomers is selected from the group of ε-caprolactone, δ-valerolactone, γ-butyrolactone, and β-propiolactone, including ε-caprolactones, δ-valerolactones, γ-butyrolactones, or β-propiolactones that have been substituted with one or more alkyl or aryl substituents at any non-carbonyl carbon atoms along the ring, including compounds in which two substituents are contained on the same carbon atom.

In an embodiment of the invention, at least one of said carbonate monomers is selected from the group of trimethylene carbonate, 5-alkyl-1,3-dioxan-2-one, 5,5-dialkyl-1,3-dioxan-2-one, or 5-alkyl-5-alkyloxycarbonyl-1,3-dioxan-2-one, ethylene carbonate, 3-ethyl-3-hydroxymethyl , propylene carbonate, trimethylolpropane monocarbonate, 4,6-dimethyl-1,3-propylene carbonate, 2,2-dimethyl trimethylene carbonate, and 1,3-dioxepan-2-one and mixtures thereof.

In an embodiment of the invention, said at least one polyester polymer obtainable by polymerization of at least one cyclic ester is selected from the group comprising poly (L-lactide); poly (D-lactide); poly (D, L-lactide); poly (meso-lactide); poly (glycolide); poly (trimethylenecarbonate); poly (epsilon-caprolactone); poly (L-lactide-co-D, L-lactide); poly (L-lactide-co-meso-lactide); poly (L-lactide-co-glycolide); poly (L-lactide-co-trimethylenecarbonate); poly (L-lactide-co-epsilon-caprolactone); poly (D, L-lactide-co-meso-lactide); poly (D, L-lactide-co-glycolide); poly (D, L-lactide-co-trimethylenecarbonate); poly (D, L-lactide-co-epsilon-caprolactone); poly (meso-lactide-co-glycolide); poly (meso-lactide-co-trimethylenecarbonate); poly (meso-lactide-co-epsilon-caprolactone); poly (glycolide-cotrimethylenecarbonate); and poly (glycolide-co-epsilon-caprolactone).

In an embodiment of the invention, said polyester is produced through a reaction of multifunctional alcohol and at least one acid chosen from the group comprising of citric acid, malic acid, fumaric acid, adipic acid, succinic acid, suberic acid, sebacic acid, dodecanedioic acid, glucaric acid, glutamic acid, glutaric acid, azelaic acid, and tartaric acid.

In an embodiment of the invention, said biodegradable polymer comprises polyurethane.

In an embodiment of the invention, said biodegradable polymer comprises polyhydroxyalkanoates.

In an embodiment of the invention, at least one of said enzymes is accelerating the degradation of said polyester obtainable by ring-opening polymerization of at least one cyclic ester.

In an embodiment of the invention, at least one of said enzymes is accelerating the degradation of said polyester obtainable by polymerization of at least one alcohol or derivative thereof and at least one acid or derivative thereof.

In an embodiment of the invention, at least one of said enzymes is selected from the group comprising oxidoreductases, transferases, hydrolases, lyases, isomerases and ligases.

In an embodiment of the invention, at least one of said enzymes is an oxidoreductase.

In an embodiment of the invention, at least one of said enzymes is a hydrolase.

In an embodiment of the invention, at least one of said enzymes is a lyase.

In an embodiment of the invention, at least one of said hydrolase enzymes is acting on ester bonds.

In a preferred embodiment of the invention, the method of cleaning a surface attached with chewing gum lumps involves enzymatic degradation targeting ester bonds in biodegradable polyesters. Thus, a chewing gum lump comprising biodegradable polyesters may be degraded at an accelerated rate due to the cleaning agent's content of enzymes acting on ester bonds.

In an embodiment of the invention, at least one of said hydrolase enzymes is a glycosylase.

In an embodiment of the invention, at least one of said hydrolase enzymes is acting on ether bonds.

In an embodiment of the invention, at least one of said hydrolase enzymes is acting on carbon-nitrogen bonds.

In an embodiment of the invention, at least one of said hydrolase enzymes is acting on peptide bonds.

In an embodiment of the invention, at least one of said hydrolase enzymes is acting on acid anhydrides.

In an embodiment of the invention, at least one of said hydrolase enzymes is acting on carbon-carbon bonds.

In an embodiment of the invention, at least one of said hydrolase enzymes is acting on halide bonds, phosphorus-nitrogen bonds, sulfur-nitrogen bonds, carbon-phosphorus bonds, sulfur-sulfur bonds, or carbon-sulfur bonds.

In an embodiment of the invention, at least one of said enzymes is selected from the group of lipases, esterases, depolymerases, peptidases and proteases.

In an embodiment of the invention, at least one of said enzymes is an endo-enzyme.

In an embodiment of the invention, at least one of said enzymes is an exo-enzyme.

In an embodiment of the invention, at least one of said enzymes has a molecular weight of 2 to 1000 kDa, preferably 10 to 500 kDa.

In an embodiment of the invention, at least two of said enzymes are combined in said cleaning agent.

In an embodiment of the invention, at least one of said enzymes requires a co-factor to carry out its catalyzing function, and wherein the co-factor is provided in the cleaning agent.

In an embodiment of the invention, said chewing gum comprises means for facilitating internal transport of enzymes or liquid structures such as fillers, proteins, starch, etc.

In an embodiment of the invention, said chewing gum comprises prolamine

In an embodiment of the invention, said prolamine has a texturizing agent entrapped therein, produced by solubilizing prolamine and then co-precipitating prolamine with a texturizing agent.

In an embodiment of the invention, said prolamine is selected from the group consisting of zein, gliadin, horedein and combinations thereof.

In an embodiment of the invention, the texturizing agent is a food grade organic acid, food grade mineral acid, an alpha-hydroxy acid, a mono-, di- or tri-carboxylic acid, a Lewis acid salt, a C3-C4 hydroxyalkyl ester of an organic acid, a C2-C5 alkyl ester of an organic acid, a C1-C5 alkyl ester of an alpha-hydroxy acid, a salt of an organic acid, a salt of an alpha-hydroxy acid, amino acid, amine salt, polymeric acids and combinations thereof.

In an embodiment of the invention, the alpha-hydroxy acid is selected from the group consisting of lactic acid, citric acid, tartaric acid, malic acid and combinations thereof.

In an embodiment of the invention, said chewing gum comprises gluten.

In an embodiment of the invention, said chewing gum lump facilitates transport or a degradation reaction through the chewing gum towards the interface region (4).

In other words, the desired effect is obtained through a reaction or a transport through/in the chewing gum from the non-attached part of the chewing gum lump to the attached part.

In an embodiment of the invention, a cleaning agent is provided to said chewing gum lump (2), said cleaning agent comprising at least one enzyme and establishing conditions targeting an activation of the at least one enzyme in relation to the at least one biodegradable polymer.

According to an embodiment of the invention, it has been realized that e.g. some biodegradable chewing gum, contrary to expectations within the art, lack from the desired non-tackiness. The invention targets chewing gum, which may be subject to a cleaning method by means of enzymatically triggered or accelerated degradation of at least one polymer of the chewing gum.

In an embodiment of the invention, at least one of said conditions comprises a temperature control of said cleaning agent or said at least one enzyme.

In an embodiment of the invention, at least one of said conditions comprises humidity in the near vicinity of said chewing gum lump (2).

Such conditions may e.g. be established by adding an amount of liquid, e.g. water, to the chewing gum lump, thereby accelerating the desired biodegradability of the biodegradable polymer(s). Evidently such an amount of liquid may be established simply as a part of the cleaning agent, i.e. if the cleaning agent comprises an aqueous solution or suspension of enzyme or enzymes.

In an embodiment of the invention, control of said conditions is performed in a time period subsequent to said activation.

In an embodiment of the invention, said conditions are controlled in at least 5 seconds subsequent to said activation.

In an embodiment of the invention, said activation is performed simultaneous to said providing of a releasing agent.

According to an embodiment of the invention, said activation may advantageously be established simultaneously to said activation of the enzymes thereby obtaining a possibility of preconditioning the enzymes with respect to e.g. temperature, concentration of a liquid suspension, etc.

In an embodiment of the invention, said activation is followed or initiated by a preconditioning of said chewing gum lump by means of physical parameters, such as heat, adding of humidity, etc.

According to an embodiment of the invention, the activation may advantageously be preceded by a physical impact of the chewing gum lump, e.g. by means of an initial heating of the chewing gum lump, an initial physical modification of the chewing gum surface, an initial adding of water or other liquid.

In an embodiment of the invention, said enzymes comprise at least two different types of enzymes.

According to an embodiment of the invention, different enzymes may be provided to the chewing gum in order to facilitate a "broad-banded" activation functioning under not-too-narrow reaction conditions. In other words, an enzyme having an optimised activation impact under one temperature interval may be supplemented by en enzyme functioning better in another temperature interval, thereby reducing the effect of varying environmentally conditions such as temperature. In other words, applying different types of enzymes may facilitate an activation functioning within a broader range of reaction conditions such as temperature and humidity.

Moreover, the invention relates to a use of enzymes for cleaning of chewing gum (2) from a surface (1), where said cleaning of the surface (1) is based on an enzymatic degradation of one or more polymers in said chewing gum.

In an embodiment of the invention, use of enzymes for cleaning of chewing gum from a surface is performed according to the methods disclosed herein.

THE FIGURES

The invention will now be described with reference to the drawings of which

Figure 1B:
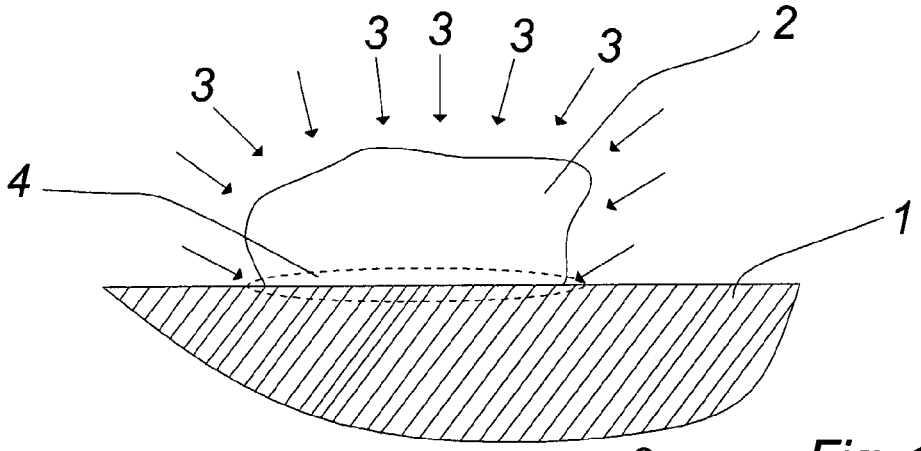
Figure 1C:
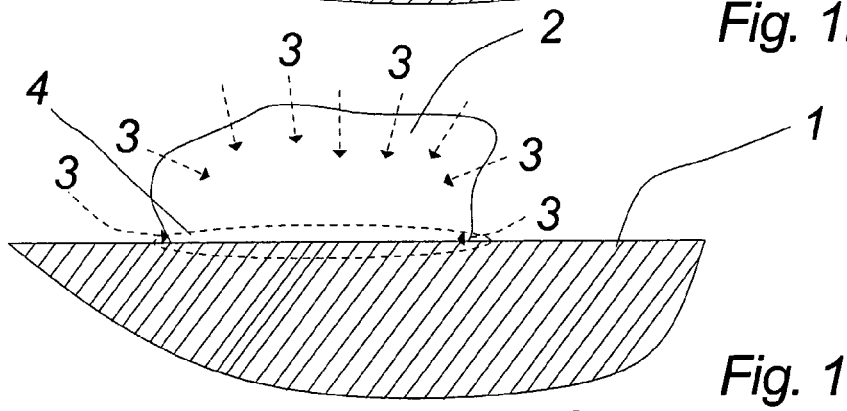
Figure 1D:
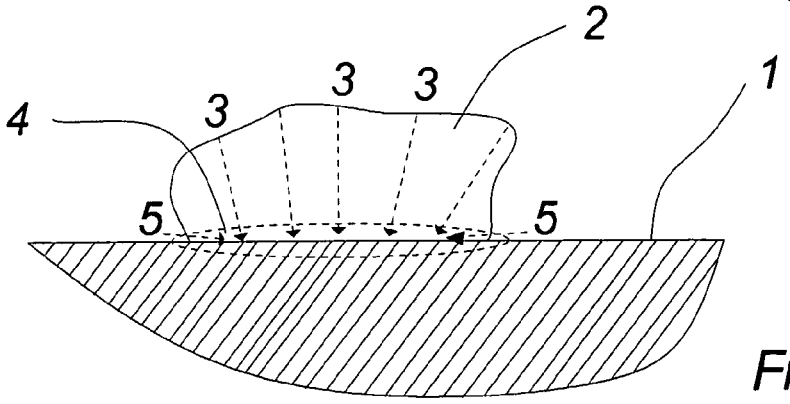
Figure 2:
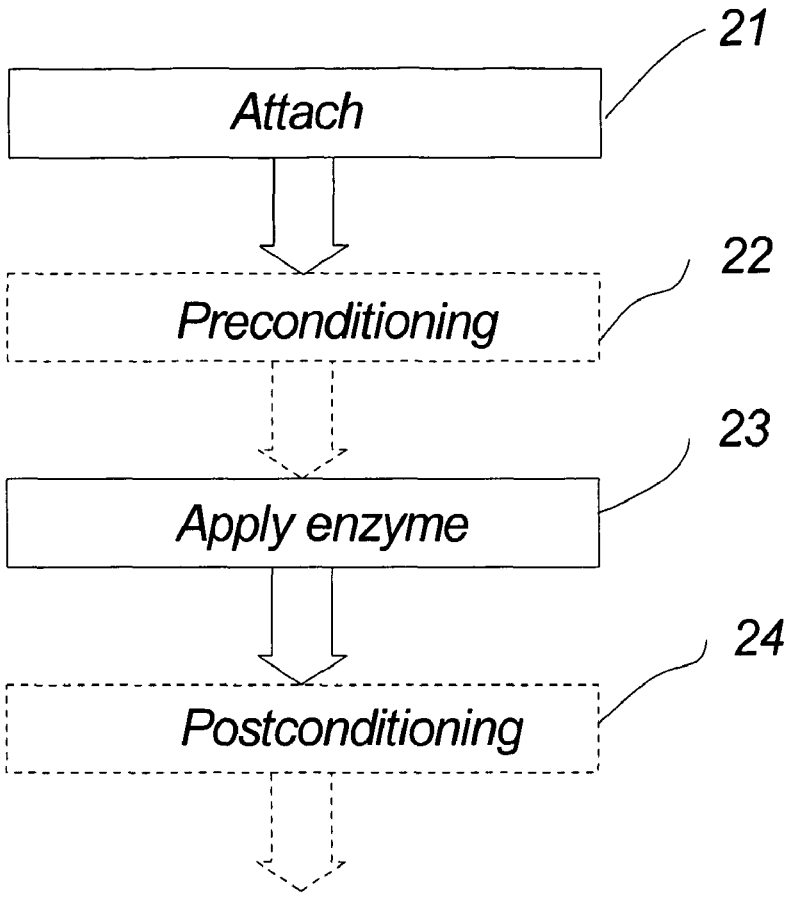

FIG. 1*a*-1*d* illustrate some basic principles of different embodiments of the invention, and FIG. 2 illustrate a general process flow of a cleaning method according to the invention, and FIG. 3*a*-3*d* illustrate a basic principle according to an embodiment of the invention.

DETAILED DESCRIPTION

The present invention relates to cleaning agents and a method for cleaning off chewing gum lumps from various surfaces. According to the invention, various cleaning agents may be provided, which are capable of removing chewing gum lumps, provided that the cleaning agents comprise dedicated enzymes, and the chewing gum comprises at least one biodegradable polymer.

The removing of chewing gum lumps may according to the invention be accelerated as the biodegradable polymer of the chewing gum may constitute a substrate for the enzymes applied via some sort of cleaning agent. Consequently, the enzymes may initiate and accelerate that the chewing gum is at least partly degraded.

In an embodiment of the invention, the applied enzymes are accelerating the degradation process involving that the chemical bonds of the polymer are broken at an accelerated rate. In an embodiment of the invention, enzymes dedicated to target the chemical bonds of specific biodegradable polymers may be preferred in the cleaning agent. In a further embodiment, the preferred enzymes may target chemical bonds between the chewing gum lump and the surface to which it is attached.

A method has thus been obtained by which biodegradable polymers in chewing gum may be degraded by means of enzymes, leading to increased polymer degradation with respect to both rate and extent of degradation as compared to non-enzymatic degradation.

It has furthermore been realized that use of enzyme-containing cleaning agents may facilitate the possibility to remove chewing gums, which comprises polymers that under normal circumstances are regarded as having only a limited biodegradability. Sometimes, such polymers having limited biodegradability have been added to chewing gum anyway, because of a favorable influence on the desired texture of the gum.

Furthermore, a chewing gum lump may have been dumped in an environment, such as indoors, where the environmental conditions are quite protecting in the sense that biodegradation is not happening, even though the chewing gum polymers may actually be regarded as biodegradable. Because of the protective environment, the biodegradable chewing gum may remain un-degraded until the enzyme-containing cleaning agent is applied according to the invention, and the enzymes triggers and accelerates the degradation process.

In other words, if chewing gum is disposed in earth in outdoor environments, there are a lot of chemical, physical and biological factors, whereby degradation of biodegradable polymers is facilitated. But falling on for example pavements or indoors, the chewing gum may not meet the required circumstances for degradation. In that case even biodegradable chewing gum may be of inconvenience. A solution according to the present invention facilitates acceleration of the degradation in environments, where the conditions are only slightly degrading. The application of enzymes by way of an enzyme-containing cleaning agent makes the degradation process progress faster than if the only influences are physical- and/or chemical factors in the surroundings.

According to a preferred definition of biodegradability according to the invention, biodegradability is a property of certain organic molecules whereby, when exposed to the natural environment or placed within a living organism, they react through an enzymatic or microbial process, often in combination with a chemical process such as hydrolysis, to form simpler compounds, and ultimately carbon dioxide, nitrogen oxides, methane, water and the like.

In the present context the term 'biodegradable polymers' means environmentally or biologically degradable polymer compounds and refers to chewing gum base components which, after dumping the chewing gum, are capable of undergoing a physical, chemical and/or biological degradation whereby the dumped chewing gum waste becomes more readily removable from the site of dumping or is eventually disintegrated to lumps or particles, which are no longer recognizable as being chewing gum remnants. The degradation or disintegration of such degradable polymers may be effected or induced by physical factors such as temperature, light, moisture, etc., by chemical factors such as oxidative conditions, pH, hydrolysis, etc. or by biological factors such as microorganisms and/or enzymes. The degradation products may be larger oligomers, trimers, dimers and monomers.

Preferably, the ultimate degradation products are small inorganic compounds such as carbon dioxide, nitrogen oxides, methane, ammonia, water, etc.

In an embodiment of the invention, the enzyme-containing cleaning agent is most effective to remove chewing gum lumps in which all of the polymer components of the gum base are environmentally or biologically degradable polymers. However the effect of the enzymes may be considerable, even if only a part of the chewing gum polymers are biodegradable.

In the present context the term 'enzyme' is used in the same sense as it is used within the arts of biochemistry and molecular biology. Enzymes are biological catalysts, typically proteins, but non-proteins with enzymatic properties have been discovered. Enzymes originate from living organisms where they act as catalysts and thereby regulate the rate at which chemical reactions proceed without themselves being altered in the process. The biological processes that occur within all living organisms are chemical processes, and enzymes regulate most of them. Without enzymes, many of these reactions would not take place at a perceptible rate. Enzymes catalyze all aspects of cell metabolism. This includes the conservation and transformation of chemical energy, the construction of cellular macromolecules from smaller precursors and the digestion of food, in which large nutrient molecules such as proteins, carbohydrates, and fats are broken down into smaller molecules.

Enzymes have assumed a great importance in industrial processes that involve organic chemical reactions. The investigations and developing of enzymes are still on going and new applications of enzymes are discovered. Synthetic polymers are often regarded as hardly degradable by enzymes and theories explaining this phenomenon have been proposed suggesting that enzymes tend to attack chain ends and that chain ends of man-made polymers tend to be deep in the polymer matrix. However, experiments according to the present invention surprisingly showed that addition of enzymes onto chewing gum lumps apparently resulted in an increased degradation of the chewing gum lump.

As catalysts enzymes generally may increase the rate of attainment of an equilibrium between reactants and products of chemical reactions. According to the present invention these reactants comprise polymers and different degrading molecules such as water, oxygen or other reactive substances, which may come into the vicinity of the polymers, whereas the products comprise oligomers, trimers, dimers, monomers and smaller degradation products. When reactions are enzyme catalyzed, at least one of the reactants forms a substrate for at least one enzyme, which means that a temporary binding emerges between reactants i.e. enzyme substrates and enzymes. In different ways this binding makes the reaction proceed faster, for instance by bringing the reactants into conformations or positions that favor reaction. An increase in reaction rate due to enzymatic influence i.e. catalysis generally occurs because of a lowering of an activation energy barrier for the reaction to take place. However, enzymes do not change the difference in free energy level between initial and final states of the reactants and products, as the presence of a catalyst has no effect on the position of equilibrium. When a catalytic process has been completed, the at least one enzyme releases the product or products and returns to its original state, ready for another substrate.

The temporary binding of one or more molecules of substrate happens in regions of the enzymes called the active sites and may for example comprise hydrogen bonds, ionic interactions, hydrophobic interactions or weak covalent bonds. In the complex tertiary structure of enzymes, an active site may assume the shape of a pocket or cleft, which fit particular substrates or parts of substrates. Some enzymes have a very specific mode of action, whereas others have a wide specificity and may catalyze a series of different substrates. Basically molecular conformation is important to the specificity of enzymes, and they may be rendered active or inactive by varying pH, temperature, solvent, etc. Yet some enzymes require co-enzymes or other co-factors to be present in order to be effective, in some cases forming association complexes in which a co-enzyme acts as a donor or acceptor for a specific group. Sometimes enzymes may be specified as endo-enzymes or exo-enzymes, thereby referring to their mode of action. According to this terminology exo-enzymes may successively attack chain ends of polymer molecules and thereby for instance liberate terminal residues or single units, whereas endo-enzymes may attack mid-chain and act on interior bonds within the polymer molecules, thereby cleaving larger molecules to smaller molecules. Generally enzymes may be attainable as liquids or powders and eventually be encapsulated in various materials.

Today, several thousand different enzymes have been discovered and more are continuously being discovered, thus the number of known enzymes is still increasing. For this reason the Nomenclature Committee of the International Union of Biochemistry and Molecular Biology (NC-IUBMB) has established a rational naming and numbering system. In the present context enzyme names are used in accordance with the recommendations devised by NC-IUBMB.

An embodiment, the invention addresses the possibility of increasing the degradability of a biodegradable chewing gum applied in a chewing gum having a polymer matrix solely or partly comprising biodegradable polymers. Another quite different aspect is rather to facilitate use of conventional polymers or biodegradable polymers, which without any catalyzing enzyme are less suitable for the application with respect to, for example, degradation rate.

In short, those and further aspects are obtained by enzymes as degradation triggers and catalysts. In others words, according to the invention, at least one biodegradable polymer of a chewing gum forms a substrate paired with a suitable enzyme.

In accordance with the general principles of the invention, suitable examples are provided here below of polymers, which according to the present invention may be regarded as biodegradable and thus as suitable substrates for the enzymes comprised in the enzyme-containing cleaning agent according to the invention.

Next, in accordance with the general principles of the invention, examples of enzymes are likewise provided, which according to the invention may be suitable for application in a cleaning agent for cleaning off chewing gum lumps.

Furthermore, further ingredients may in accordance with the general principles of the invention be applicable in cleaning agents and in chewing gum.

Suitable examples of environmentally or biologically degradable chewing gum base polymers, which may be susceptible to degradation by the enzyme-containing cleaning agent according to the invention, include degradable polyesters, poly(ester-carbonates), polycarbonates, polyester amides, polypeptides, homopolymers of amino acids such as polylysine, and proteins including derivatives thereof such as e.g. protein hydrolysates including a zein hydrolysate. Particularly useful compounds of this type include polyester polymers obtained by the polymerization of one or more cyclic esters such as lactide, glycolide, trimethylene carbonate, δ-valerolactone, β-propiolactone and ϵ-caprolactone, and polyesters obtained by condensation polymerization of a mixture of open-chain polyacids and polyols, for instance, adipic acid and di(ethylene glycol). Hydroxy carboxylic acids such as 6-hydroxycaproic acid may also be used to form polyesters or they may be used in conjunction with mixtures of polyacids and polyols. Such degradable polymers may be homopolymers, copolymers or terpolymers, including graft- and block-polymers.

Biodegradable polyester compounds, which may be particularly suitable substrates for the enzymes of enzyme-containing cleaning agents according to the invention, may be produced from cyclic esters and may be obtained by ring-opening polymerization of one or more cyclic esters, which include glycolides, lactides, lactones and carbonates. The polymerization process to obtain such advantageously degradable polyesters may take place in the presence of at least one appropriate catalyst such as metal catalysts, of which stannous octoate is a non-limiting example and the polymerization process may be initiated by initiators such as polyols, polyamines or other molecules with multiple hydroxyl or other reactive groups and mixtures thereof.

Accordingly, the biodegradable polyesters produced by condensation polymerization through reaction of at least one alcohol or derivative thereof and at least one acid or derivative thereof may also be particularly suitable substrates for the enzymes of enzyme-containing cleaning agents according to the invention. These polycondensation polyesters may generally be prepared by step-growth polymerization of di-, tri- or higher-functional alcohols or esters thereof with di-, tri-or higher-functional aliphatic or aromatic carboxylic acids or esters thereof. Likewise, also hydroxy acids or anhydrides and halides of polyfunctional carboxylic acids may be used as monomers. The polymerization may involve direct polyesterification or transesterification and may be catalyzed. Use of branched monomers suppresses the crystallinity of the polyester polymers. Mixing of dissimilar monomer units along the chain also suppresses crystallinity. To control the reaction and the molecular weight of the resulting polymer the polymer chains may be ended by addition of monofunctional alcohols or acids and/or to utilize a stoichiometric imbalance between acid groups and alcohol groups or derivatives of either. Also the adding of long chain aliphatic carboxylic acids or aromatic monocarboxylic acids may be used to control the degree of branching in the polymer and conversely multifunctional monomers are sometimes used to create branching. Moreover, following the polymerization monofunctional compounds may be used to endcap the free hydroxyl and carboxyl groups.

Furthermore, polyfunctional carboxylic acids are in general high-melting solids that have very limited solubility in the polycondensation reaction medium. Often esters or anhydrides of the polyfunctional carboxylic acids are used to overcome this limitation. Polycondensations involving carboxylic acids or anhydrides produce water as the condensate, which requires high temperatures to be driven off. Thus, polycondensations involving transesterification of the ester of a polyfunctional acid are often the preferred polymerization process. For example, the dimethyl ester of terephthalic acid may be used instead of terephthalic acid itself. In this case, methanol rather than water is condensed, and the former can be driven off more easily than water. Usually, the reaction is carried out in the bulk (no solvent) and high temperatures and vacuum are used to remove the by-product and drive the reaction to completion. In addition to an ester or anhydride, a halide of the carboxylic acid may also be used under certain circumstances.

Additionally for preparation of polyesters of this polycondensation-type, the preferred polyfunctional carboxylic acids or derivatives thereof are usually either saturated or unsaturated aliphatic or aromatic and contain 2 to 100 carbon atoms and more preferably 4 to 18 carbon atoms. In the polymerization of this type of polyester some applicable examples of carboxylic acids, which may be employed as such or as derivatives thereof, includes aliphatic polyfunctional carboxylic acids such as oxalic, malonic, citric, succinic, malic, tartaric, fumaric, maleic, glutaric, glutamic, adipic, glucaric, pimelic, suberic, azelaic, sebacic, dodecanedioic acid, etc. and cyclic aliphatic polyfunctional carboxylic acids such as cyclopropane dicarboxylic acid, cyclobutane dicarboxylic acid, cyclohexane dicarboxylic acid, etc. and aromatic polyfunctional carboxylic acids such as terephthalic, isophthalic, phthalic, trimellitic, pyromellitic and naphthalene 1,4-, 2,3-, 2,6-dicarboxylic acids and the like. For the purpose of illustration and not limitation, some examples of carboxylic acid derivatives include hydroxy acids such as 3-hydroxy propionic acid and 6-hydroxycaproic acid and anhydrides, halides or esters of acids, for example dimethyl or diethyl esters, corresponding to the already mentioned acids, which means esters such as dimethyl or diethyl oxalate, malonate, succinate, fumarate, maleate, glutarate, adipate, pimelate, suberate, azelate, sebacate, dodecanedioate, terephthalate, isophthalate, phthalate, etc. Generally speaking, methyl esters are sometimes more preferred than ethyl esters due to the fact that higher boiling alcohols are more difficult to remove than lower boiling alcohols.

Furthermore, the usually preferred polyfunctional alcohols, for preparation of the polycondensation-type polyesters, contain 2 to 100 carbon atoms as for instance polyglycols and polyglycerols. In the polymerization process of this type of polyester some applicable examples of alcohols, which may be employed as such or as derivatives thereof, includes polyols such as ethylene glycol, 1,2-propanediol, 1,3-propanediol, 1,3-butanediol, 1,4-butanediol, 1,6-hexanediol, diethylene glycol, 1,4-cyclohexanediol, 1,4-cyclohexanedimethanol, neopentyl glycol, glycerol, trimethylolpropane, pentaerythritol, sorbitol, mannitol, etc. For the purpose of illustration and not limitation, some examples of alcohol derivatives include triacetin, glycerol palmitate, glycerol sebacate, glycerol adipate, tripropionin, etc.

Additionally, with regard to polymerization of polycondensation-type polyesters, the chain-stoppers sometimes used are monofunctional compounds. They may preferably either be monohydroxy alcohols containing 1-20 carbon atoms or monocarboxylic acids containing 2-26 carbon atoms. General examples are medium or long-chain fatty alcohols or acids, and specific examples include monohydroxy alcohols such as methanol, ethanol, butanol, hexanol, octanol, etc. and lauryl alcohol, myristyl alcohol, cetyl alcohol, stearyl alcohol, stearic alcohol, etc. and monocarboxylic acids such as acetic, lauric, myristic, palmitic, stearic, arachidic, cerotic, dodecylenic, palmitoleic, oleic, linoleic, linolenic, erucic, benzoic, naphthoic acids and substituted napthoic acids, 1-methyl-2 naphthoic acid and 2-isopropyl-1-naphthoic acid, etc.

Moreover an acid catalyst or a transesterification catalyst is typically used in the polymerization of polyesters by polycondensation, and non-limiting examples of those are the metal catalysts such as acetates of manganese, zinc, calcium, cobalt or magnesium, and antimony(III)oxide, germanium oxide or halide and tetraalkoxygermanium, titanium alkoxide, zinc or aluminum salts.

Other applicable polymers may comprise polyurethane and polyhydroxyalknoates.

Suitable enzymes, which may be applicable in an enzyme-containing cleaning agent in accordance with the general principles of the present invention, may be identified as belonging to six classes according to their function: Oxidoreductases, transferases, hydrolases, lyases, isomerases and ligases. Oxidoreductases catalyze oxidation-reduction reactions, and the substrate oxidized is regarded as hydrogen or electron donor. Transferases catalyze transfer of functional groups from one molecule to another. Hydrolases catalyze hydrolytic cleavage of various bonds. Lyases catalyze cleavage of various bonds by other means than by hydrolysis or oxidation, meaning for example that they catalyze removal of a group from or addition of a group to a double bond, or other cleavages involving electron rearrangement. Isomerases catalyze intramolecular rearrangement, meaning changes within one molecule. Ligases catalyze reactions in which two molecules are joined.

Some preferred enzymes according to the invention are oxidoreductases, which may act on different groups of donors, such as the CH—OH group, the aldehyde or oxo group, the CH—CH group, the CH—$NH_2$ group, the CH—NH group, NADH or NADPH, nitrogenous compounds, a sulfur group, a heme group, diphenols and related substances, hydrogen, single donors with incorporation of molecular oxygen, paired donors with incorporation or reduction of molecular oxygen or others. Oxidoreductases may also be acting on $CH_2$ groups or X—H and Y—H to form an X—Y bond. Typically enzymes belonging to the group of oxidoreductases may be referred to as oxidases, oxygenases, hydrogenases, dehydrogenases, reductases or the like.

Specific examples of oxidoreductases comprise oxidases such as malate oxidase, glucose oxidase, hexose oxidase, aryl-alcohol oxidase, alcohol oxidase, long-chain-alcohol oxidase, glycerol-3-phosphate oxidase, polyvinyl-alcohol oxidase, D-arabinono-1,4-lactone oxidase, D-mannitol oxidase, xylitol oxidase, oxalate oxidase, carbon-monoxide oxidase, 4-hydroxyphenylpyruvate oxidase, dihydrouracil oxidase, ethanolamine oxidase, L-aspartate oxidase, sarcosine oxidase, urate oxidase, methanethiol oxidase, 3-hydroxyanthranilate oxidase, laccase, catalase, fatty-acid peroxidase , peroxidase, diarylpropane peroxidase, ferroxidase, pteridine oxidase, columbamine oxidase and the like.

Further specific examples of oxidoreductases comprise oxygenases such as catechol 1,2-dioxygenase, gentisate 1,2-dioxygenase, homogentisate 1,2-dioxygenase, lipoxygenase, ascorbate 2,3-dioxygenase, 3-carboxyethylcatechol 2,3-dioxygenase, indole 2,3-dioxygenase, caffeate 3,4-dioxygenase, arachidonate 5-lipoxygenase, biphenyl-2,3-diol 1,2-dioxygenase, linoleate 11-lipoxygenase, acetylacetone-cleaving enzyme, lactate 2-monooxygenase, phenylalanine 2-monooxygenase, inositol oxygenase and the like.

Further specific examples of oxidoreductases comprise dehydrogenases such as alcohol dehydrogenase, glycerol dehydrogenase, propanediol-phosphate dehydrogenase, L-lactate dehydrogenase, D-lactate dehydrogenase, glycerate dehydrogenase, glucose 1-dehydrogenase, galactose 1-dehydrogenase, allyl-alcohol dehydrogenase, 4-hydroxybutyrate dehydrogenase, octanol dehydrogenase, aryl-alcohol dehydrogenase, cyclopentanol dehydrogenase, long-chain-3-hydroxyacyl-CoA dehydrogenase, L-lactate dehydrogenase, D-lactate dehydrogenase, butanal dehydrogenase, terephthalate 1,2-cis-dihydrodiol dehydrogenase, succinate dehydrogenase, glutamate dehydrogenase, glycine dehydrogenase, hydrogen dehydrogenase, 4-cresol dehydrogenase, phosphonate dehydrogenase and the like.

Specific examples of reductases belonging to the group of oxidoreductases comprise enzymes such as diethyl 2-methyl-3-oxosuccinate reductase, tropinone reductase, long-chain-fatty-acyl-CoA reductase, carboxylate reductase, D-proline reductase, glycine reductase and the like.

Other preferred enzymes according to the invention are lyases, which may belong to either of the following groups: carbon-carbon lyases, carbon-oxygen lyases, carbon-nitrogen lyases, carbon-sulfur lyases, carbon-halide lyases, phosphorus-oxygen lyases and other lyases.

Among carbon-carbon lyases are carboxy-lyases, aldehyde-lyases, oxo-acid-lyases and others. Some specific exarnples belonging to those groups are oxalate decarboxylase, acetolactate decarboxylase, aspartate 4-decarboxylase, lysine decarboxylase, aromatic-L-amino-acid decarboxylase, methylmalonyl-CoA decarboxylase, carnitine decarboxylase, indole-3-glycerol-phosphate synthase, gallate decarboxylase, branched-chain-2-oxoacid, decarboxylase, tartrate decarboxylase, arylmalonate decarboxylase, fructose-bisphosphate aldolase, 2-dehydro-3-deoxy-phosphogluconate aldolase, trimethylamine-oxide aldolase, propioin synthase, lactate aldolase, vanillin synthase, isocitrate lyase, hydroxymethylglutaryl-CoA lyase, 3-hydroxyaspartate aldolase, tryptophanase, deoxyribodipyrimidine photo-lyase, octadecanal decarbonylase and the like.

Among carbon-oxygen lyases are hydro-lyases, lyases acting on polysaccharides, phosphates and others. Some specific examples are carbonate dehydratase, funarate hydratase, aconitate hydratase, citrate dehydratase, arabinonate dehydratase, galactonate dehydratase, altronate dehydratase, marnonate dehydratase, dihydroxy-acid dehydratase, 3-dehydroquinate dehydratase, propanediol dehydratase, glycerol dehydratase, maleate hydratase, oleate hydratase, pectate lyase, poly(β-D-mannuronate) lyase, oligogalacturonide lyase, poly(α-L-guluronate) lyase, xanthan lyase, ethanolamine-phosphate phospho-lyase, carboxymethyloxysuccinate lyase and others.

Among carbon-nitrogen lyases are ammonia-lyases, lyases acting on amides, amidines, etc., amine-lyases and others. Specific examples of those groups of lyases are aspartate ammonia-lyase, phenylalanine ammonia-lyase, ethanolamine ammonia-lyase, glucosaminate ammonia-lyase, argininosuccinate lyase, adenylosuccinate lyase, ureidoglycolate tyase, 3-ketovalidoxylamine C-N-lyase Among carbon-sulfur lyases are some specific examples such as dimethylpropiothetin dethiomethylase, ailiin lyase, lactoylglutathione lyase and cysteine lyase.

Among carbon-halide lyases are some specific examples such as 3-chloro-D-alanine dehydrochlorinase or dichloromethane dehalogenase.

Among phosphorus-oxygen lyases are some specific examples such as adenylate cyclase,cytidylate cyclase, and glycosylphosphatidylinositol diacylglycerol-lyase.

In the most preferred embodiments of the invention, the applied enzymes are hydrolases comprising glycosylases, enzymes acting on acid anhydrides and enzymes acting on specific bonds such as ester bonds, ether bonds, carbon-nitrogen bonds, peptide bonds, carbon-carbon bonds, halide bonds, phosphorus-nitrogen bonds, sulfur-nitrogen bonds, carbon-phosphorus bonds, sulfur-sulfur bonds or carbon-sulfur bonds.

Among the glycosylases the prefered enzymes are glycosidases, which are capable of hydrolysing O- and S-glycosyl compounds or N-glycosyl compounds. Some examples of glycosylases are α-amylase, β-amylase, glucan 1,4-α-glucosidase, cellulase, endo-1,3(4)-β-glucanase, inulinase, endo-1,4-β-xylanase, oligo-1,6-glucosidase, dextranase, chitinase, polygalacturonase, lysozyme, levanase, quercitrinase, galacturan 1,4-α-galacturonidase, isoamylase, glucan 1,6-α-glucosidase, glucan endo-1,2-β-glucosidase, licheninase, agarase, exo-poly-α-galacturonosidase, κ-carrageenase, steryl-β-glucosidase, strictosidine β-glucosidase, mannosyl-oligosaccharide glucosidase, lactase, oligoxyloglucan β-glycosidase, polymannuronate hydrolase, chitosanase, poly(ADP-ribose) glycohydrolase, purine nucleosidase, inosine nucleosidase, uridine nucleosidase, adenosine nucleosidase and others.

Among enzymes acting on acid anhydrides are for instance those acting on phosphorus- or sulfonyl-containing anhydrides. Some examples of enzymes acting on acid anhydrides are inorganic diphosphatase, trimetaphosphatase, adenosinetriphosphatase, apyrase, nucleoside-diphosphatase, acylphosphatase, nucleotide diphosphatase, endopolyphosphatase, exopolyphosphatase, nucleoside phosphoacylhydrolase, triphosphatase, CDP-diacylglycerol-diphosphatase, undecaprenyldiphosphatase, dolichyldiphosphatase, oligosaccharide-diphosphodolichol diphosphatase, heterotrimeric G-protein GTPase, small monomeric GTPase, dynamin GTPase, tubulin GTPase, diphosphoinositol-polyphosphate diphosphatase, $H^+$-exporting ATPase, monosaccharide-transporting ATPase, maltose-transporting ATPase, glycerol-3-phosphate-transporting ATPase, oligopeptide-transporting ATPase, polyamine-transporting ATPase, peptide-transporting ATPase, fatty-acyl-CoA-transporting ATPase, protein-secreting ATPase and others.

In an embodiment of the invention, the most preferred enzymes are those acting on ester bonds, among which are carboxylic ester hydrolases, thiolester hydrolases, phosphoric ester hydrolases, sulfuric ester hydrolases and ribonucleases. Some examples of enzymes acting on ester bonds are acetyl-CoA hydrolase, palmitoyl-CoA hydrolase, succinyl-CoA hydrolase, 3-hydroxyisobutyryl-CoA hydrolase, hydroxymethylglutaryl-CoA hydrolase, hydroxyacylglutathione hydrolase, glutathione thiolesterase, formyl-CoA hydrolase, acetoacetyl-CoA hydrolase, S-formylglutathione hydrolase, S-succinylglutathione hydrolase, oleoyl-[acyl-carrier-protein] hydrolase, ubiquitin thiolesterase, [citrate-(pro-3S)-lyase] thiolesterase, (S)-methylmalonyl-CoA hydrolase, ADP-dependent short-chain-acyl-CoA hydrolase, ADP-dependent medium-chain-acyl-CoA hydrolase, acyl-CoA hydrolase, dodecanoyl-[acyl-carrier protein] hydrolase, palmitoyl-(protein) hydrolase, 4-hydroxybenzoyl-CoA thioesterase, 2-(2-hydroxyphenyl)benzenesulfinate hydrolase, alkaline phosphatase, acid phosphatase, phosphoserine phosphatase, phosphatidate phosphatase, 5'-nucleotidase, 3'-nucleotidase, 3'(2'),5'-bisphosphate nucleotidase, 3-phytase, glucose-6-phosphatase, glycerol-2-phosphatase, phosphoglycerate phosphatase, glycerol-1-phosphatase, mannitol-1-phosphatase, sugar-phosphatase, sucrose-phosphatase, inositol-1 (or 4)-monophosphatase, 4-phytase, phosphatidylglycerophosphatase, ADPphosphoglycerate phosphatase, N-acylneuraminate-9-phosphatase, nucleotidase, polynucleotide 3'-phosphatase, [glycogen-synthase-D] phosphatase, [pyruvate dehydrogenase (lipoamide)]-phosphatase, [acetyl-CoA carboxylase]-phosphatase, 3-deoxy-manno-octulosonate-8-phosphatase, polynucleotide 5'-phosphatase, sugar-terminal-phosphatase, alkylacetylglycerophosphatase, 2-deoxyglucose-6-phosphatase, glucosylglycerol 3-phosphatase, 5-phytase, phosphodiesterase I, glycerophosphocholine phosphodiesterase, phospholipase C, phospholipase D, phosphoinositide phospholipase C, sphingomyelin phosphodiesterase, glycerophosphocholine cholinephosphodiesterase, alkylglycerophosphoethanolamine phosphodiesterase, glycerophosphoinositol glycerophosphodiesterase, arylsulfatase, steryl-sulfatase, glycosulfatase, choline-sulfatase, cellulose-polysulfatase, monomethyl-sulfatase, D-lactate-2-sulfatase, glucuronate-2-sulfatase, prenyl-diphosphatase, aryldialkylphosphatase, diisopropylfluorophosphatase, oligonucleotidase, poly(A)-specific ribonuclease, yeast ribonuclease, deoxyribonuclease (pyrimidine dimer), *Physarum polycephalum* ribonuclease, ribonculease alpha, *Aspergillus* nuclease $S_1$, *Serratia marcescens* nuclease and more.

In an embodiment of the invention, the most preferred enzymes acting on ester bonds are carboxylic ester hydrolases such as carboxylesterase, arylesterase, triacylglycerol lipase, phospholipase $A_2$, lysophospholipase, acetylesterase, acetylcholinesterase, cholinesterase, tropinesterase, pectinesterase, sterol esterase, chlorophyllase, L-arabinonolactonase, gluconolactonase, uronolactonase, tannase, retinyl-palmitate esterase, hydroxybutyrate-dimer, hydrolase, acylglycerol lipase, 3-oxoadipate enol-lactonase, 1,4-lactonase, galactolipase, 4-pyridoxolactonase, acylcarnitine hydrolase, aminoacyl-tRNA hydrolase, D-arabinonolactonase, 6-phosphogluconolactonase, phospholipase $A_1$, 6-acetylglucose deacetylase, lipoprotein lipase, dihydrocoumarin hydrolase, limonin-D-ring-lactonase, steroid-lactonase, triacetate-lactonase, actinomycin lactonase, orsellinate-depside, hydrolase, cephalosporin-C deacetylase, chlorogenate hydrolase, α-amino-acid, esterase, 4-methyloxaloacetate esterase, carboxymethylenebutenolidase, deoxylimonate A-ring-lactonase, 1 -alkyl-2-acetylglycerophosphocholine esterase, fusarinine-C ornithinesterase, sinapine esterase, wax-ester hydrolase, phorbol-diester hydrolase, phosphatidylinositol deacylase, sialate O-acetylesterase, acetoxybutynylbithiophene deacetylase, acetylsalicylate deacetylase, methylumbelliferyl-acetate deacetylase, 2-pyrone-4,6-dicarboxylate lactonase, N-acetylgalactosaminoglycan deacetylase, juvenile-hormone esterase, bis(2-ethylhexyl)phthalate esterase, protein-glutamate, methylesterase, 11 -cis-retinyl-palmitate hydrolase, all-trans-retinyl-palmitate hydrolase, L-rhamnono-1,4-lactonase, 5-(3,4-diacetoxybut-1-ynyl)-2,2'-bithiophene deacetylase, fatty-acyl-ethyl-ester synthase, xylono-1,4-lactonase, cetraxate benzylesterase, acetylalkylglycerol acetylhydrolase, acetylxylan esterase, feruloyl esterase, cutinase, poly(3-hydroxybutyrate) depolymerase, poly(3-hydroxyoctanoate), depolymerase acyloxyacyl hydrolase, acyloxyacyl hydrolase, polyneuridine-aldehyde esterase and others.

Accordingly, enzymes acting on ether bonds include trialkylsulfonium hydrolases and ether hydrolases. Enzymes acting on ether bonds may act on both thioether bonds and on the oxygen equivalent. Specific enzyme examples belonging to these groups are adenosylhomocysteinase, adenosylmethionine hydrolase, isochorismatase, alkenylglycerophosphocholine hydrolase, epoxide hydrolase, trans-epoxysuccinate hydrolase, alkenylglycerophosphoethanolamine hydrolase, leukotriene-$A_4$ hydrolase, hepoxilin-epoxide hydrolase and limonene-1,2-epoxide hydrolase.

Among enzymes acting on carbon-nitrogen bonds are linear amides, cyclic amides, linear amidines, cyclic amidines, nitriles and other compounds. Specific examples belonging to these groups are asparaginase, glutaminase, ω-amidase, amidase, urease, β-ureidopropionase, arylformamidase, biotinidase, aryl-acylamidase, amino-acylase, aspartoacylase, acetylornithine deacetylase, acyl-lysine deacylase, succinyldiaminopimelate desuccinylase, pantothenase, ceramidase, choloylglycine hydrolase, N-acetylglucosamine-6-phosphate deacetylase, N-acetylmuramoyl-L-alanine amidase, 2-(acetamidomethylene)succinate hydrolase, 5-aminopentanamidase, formylmethionine deformylase, hippurate hydrolase, N-acetylglucosamine deacetylase, D-glutaminase, N-methyl-2-oxoglutaramate hydrolase, glutamin-(asparagin-)ase, alkylamidase, acylagmatine amidase, chitin deacetylase, peptidyl-glutaminase, N-carbamoyl-sarcosine amidase, N-(long-chain-acyl)ethanolarnine deacylase, mimosinase, acetylputrescine deacetylase, 4-acetamidobutyrate deacetylase, theanine hydrolase, 2-(hydroxymethyl)-3-(acetamidomethylene)succinate hydrolase, 4-methyleneglutaminase, N-formylglutamate deformylase, glycosphingolipid deacylase, aculeacin-A deacylase, peptide deformylase, dihydropyrimidinase, dihydroorotase, carboxymethyl-hydantoinase, creatininase, L-lysine-lactamase, arginase, guanidinoacetase, creatinase, allantoicase, cytosine deaminase, riboflavinase, thiaminase, 1-aminocyclo-propane-1-carboxylate deamin and more.

Some preferred enzymes according to an embodiment of the present invention belong to the group of enzymes acting on peptide bonds, which group is also referred to as peptidases. Peptidases can be further divided into exopeptidases that act only near a terminus of a polypeptide chain and endopeptidases that act internally in polypeptide chains. Enzymes acting on peptide bonds include enzymes selected from the group of aminopeptidases, dipeptidases, di- or tripeptidyl-peptidases, peptidyl-dipeptidases, serine-type carboxypeptidases, metallocarboxypeptidases, cysteine-type carboxypeptidases, omega peptidases, serine endopeptidases, cysteine endopeptidases, aspartic endopeptidases, metalloendopeptidases and threonine endopeptidases. Some specific examples of enzymes belonging to these groups are cystinyl aminopeptidase, tripeptide aminopeptidase, prolyl aminopeptidase, arginyl aminopeptidase, glutamyl aminopeptidase, cytosol alanyl aminopeptidase, lysyl aminopeptidase, Met-X dipeptidase, non-stereospecific dipeptidase, cytosol nonspecific dipeptidase, membrane dipeptidase, dipeptidase E, dipeptidyl-peptidase I, dipeptidyl-dipeptidase, tripeptidyl-peptidase I, tripeptidyl-peptidase II, X-Pro dipeptidyl-peptidase, peptidyl-dipeptidase A, lysosomal Pro-X carboxypeptidase, carboxypeptidase C, acylaminoacyl-peptidase, peptidyl-glycinamidase, β-aspartyl-peptidase, ubiquitinyl hydrolase 1, chymotrypsin, chymotrypsin C, metridin, trypsin, thrombin, plasmin, enteropeptidase, acrosin, α-Lytic endopeptidase, glutamyl endopeptidase, cathepsin G, cucumisin, prolyl oligopeptidase, brachyurin, plasma kallikrein, tissue kallikrein, pancreatic elastase, leukocyte elastase, chymase, cerevisin, hypodermin C, lysyl endopeptidase, endopeptidase La, γ-renin, venombin AB, leucyl endopeptidase, tryptase, scutelarin, kexin, subtilisin, oryzin, endopeptidase K, thermomycolin, thermitase, endopeptidase So, t-plasminogen activator, protein C (activated), pancreatic endopeptidase E, pancreatic elastase II, IgA-specific serine endopeptidase, u-plasminogen activator, venombin A, furin, myeloblastin, semenogelase, granzyme A, granzyme B, streptogrisin A, streptogrisin B, glutamyl endopeptidase II, oligopeptidase B, omptin, togavirin, flavivirin, endopeptidase Clp, proprotein convertase 1, proprotein convertase 2, lactocepin, assemblin, hepacivirin, spermosin, pseudomonalisin, xanthomonalisin, C-terminal processing peptidase, physarolisin, cathepsin B, papain, ficain, chymopapain, asclepain, clostripain, streptopain, actinidain, cathepsin L, cathepsin H, cathepsin T, glycyl endopeptidase, cancer procoagulant, cathepsin S, picornain 3C, picornain 2A, caricain, ananain, stem bromelain, fruit bromelain, legumain, histolysain, caspase-1, gingipain R, cathepsin K, adenain, bleomycin hydrolase, cathepsin F, cathepsin O, cathepsin V, nuclear-inclusion-a endopeptidase, helper-component proteinase, L-peptidase, gingipain K, staphopain, separase, V-cath endopeptidase, cruzipain, calpain-1, calpain-2, pepsin A, pepsin B, gastricsin, chymosin, cathepsin D, nepenthesin, renin, Pro-opiomelanocortin converting enzyme, aspergillopepsin I, aspergillopepsin II, penicillopepsin, rhizopuspepsin, endothiapepsin, mucorpepsin, candidapepsin, saccharopepsin, rhodotorulapepsin, acrocylindropepsin, polyporopepsin, pycnoporopepsin, scytalidopepsin A, scytalidopepsin B, cathepsin E, barrierpepsin, signal peptidase II, plasmepsin I, plasmepsin II, phytepsin, yapsin 1, thermopsin, prepilin peptidase, nodavirus endopeptidase, memapsin 1, memapsin 2, atrolysin A, microbial collagenase, leucolysin, stromelysin 1, meprin A, procollagen C-endopeptidase, astacin, pseudolysin, thermolysin, bacillolysin, aureolysin, coccolysin, mycolysin, gelatinase B, leishmanolysin, saccharolysin, gametolysin, serralysin, horrilysin, ruberlysin, bothropasin, oligopeptidase A, endothelin-converting enzyme, AD-AM10 endopeptidase and others.

Suitable enzymes acting on carbon-carbon bonds, which may be found in ketonic substances include, but are not limited to oxaloacetase, fumarylacetoacetase, kynureninase, phloretin hydrolase, acylpyruvate hydrolase, acetylpyruvate hydrolase, β-diketone hydrolase, 2,6-dioxo-6-phenylhexa-3-enoate hydrolase, 2-hydroxymuconate-semialdehyde hydrolase and cyclohexane-1,3-dione hydrolase.

Examples of enzymes within the group acting on halide bonds are alkylhalidase, 2-haloacid dehalogenase, haloacetate dehalogenase, thyroxine deiodinase, haloalkane dehalogenase, 4-chlorobenzoate dehalogenase, 4-chlorobenzoyl-CoA dehalogenase, atrazine chlorohydrolase and the like.

Further examples according to the present invention of enzymes acting on specific bonds are phosphoamidase, N-sulfoglucosamine sulfohydrolase, cyclamate sulfohydrolase, phosphonoacetaldehyde hydrolase, phosphonoacetate hydrolase, trithionate hydrolase, UDPsulfoquinovose synthase and the like.

According to the present invention enzymes applied in a cleaning agent for degradation of biodegradable chewing gum lumps may be of one type alone or different types in combination.

Some enzymes require co-factors to be effective. Examples of such co-factors are 5,10-methenyltetrahydrofolate, ammonia, ascorbate, ATP, bicarbonate, bile salts, biotin, bis(molybdopterin guanine dinucleotide)molybdenum cofactor, cadmium, calcium, cobalamin, cobalt, coenzyme F430, coenzyme-A, copper, dipyrromethane, dithiothreitol, divalent cation, FAD, flavin, flavoprotein, FMN, glutathione, heme, heme-thiolate, iron, iron(2+), iron-molybdenum, iron-sulfur, lipoyl group, magnesium, manganese, metal ions, molybdenum, molybdopterin, monovalent cation, NAD, NAD(P)H, nickel, potassium, PQQ, protoheme IX, pyridoxal-phosphate, pyruvate, selenium, siroheme, sodium, tetrahydropteridine, thiamine diphosphate, topaquinone, tryptophan tryptophylquinone (TTQ), tungsten, vanadium and zinc.

According to four preferred embodiments of the invention, a chewing gum comprising at least one biodegradable polymer may be prepared by either a conventional two-step batch process, a less used but quite promising one-step process or e.g. a continuous mixing performed e.g. by means of an extruder and the fourth preferred embodiment is to prepare the chewing gum by use of compression techniques.

The two-step process comprises separate manufacturing of gum base and subsequently mixing of gum base with further chewing gum ingredients. Several other methods may be applied as well. Examples of two-step processes are well described in the prior art. An example of a one-step process is disclosed in WO 02/076229 A1, hereby included by reference. Examples of continuous mixing methods are disclosed in U.S. Pat. Nos. 6,017,565 A, 5,976,581 A and 4,968,511 A, hereby included by reference. Examples of processes to produce compressed chewing gum are disclosed in U.S. Pat. Nos. 4,405,647, 4,753,805, WO 8603967, EP 513978, 5,866,179, WO/97/21424, EP 0 890 358, DE 19751330, 6,322,828, PCT/DK03/00070, PCT/DK03/00465, hereby included by reference.

Turning now to one of several principal embodiments of the invention, a chewing gum will be described in more general terms.

First of all, the chewing gum comprises a polymer composition, which is partly or solely based on biodegradable polymers. These polymers are, as it is the case with conventional non-degradable chewing gum, the components of the chewing gum providing the texture and "masticatory" properties of a chewing gum.

Moreover, the chewing gum comprises further additives applied for obtaining the desired fine-tuning of the above-mentioned chewing gum. Such additives may e.g. comprise softeners, emulsifiers, etc.

Moreover, the chewing gum comprises further ingredients applied for obtaining the desired taste and properties of the above-mentioned chewing gum. Such ingredients may e.g. comprise sweeteners, flavors, acids, etc.

It should be stressed that the above-mentioned additives and ingredients may interact in function. As an example, flavors may e.g. be applied as or act as softeners in the complete system. A strict distinction between additives and ingredients may typically not be established.

Furthermore, a coating may be applied for complete or partial encapsulation of the obtained chewing gum center. In the present context coating and center filling are regarded as a whole, thus using the term "chewing gum" includes both the chewing gum body and an optional coating.

A chewing gum applied according to the present invention may e.g. be prepared with ingredients or additives such as sweeteners, flavors, acids, emulsifier, softeners, plasticizers, etc as described in the descriptions of the documents WO 02/076227, A1 WO 02/076230 A1, WO 02/076228 A1, WO 02/076229 A1, WO 02/076231 A1, WO 2004/028268 A1, WO 2004/028267 A1, WO 2004/028269 A1, WO 2004/028265 A1, WO 2004/028266 A1, WO 2004/028270 A1 and PCT/DK2003/000939 hereby incorporated by reference.

It should also be stressed, also as explained in several of the above referenced applications, that the biodegradable polymers may also be applied together with conventional polymers, such as conventional elastomers and/or resins.

A preferred cleaning agent applied according to the provisions of the invention will be described below. The cleaning agent comprises one or several different enzymes. In a preferred cleaning agent, the enzyme(s) is/are mixed in an aqueous mixture. The mixture may both comprise a suspension or a solution of the enzyme in a liquid and the liquid is preferably water as water itself has a positive impact on the desired degradation of the polymer chains of the targeted chewing gum. Moreover, water itself may, of course, be regarded environmentally compatible even if residues may appear.

The applied types of enzymes may typically be chosen to target known biodegradable polymers of chewing gum lumps. In this context is should be noted that a relative comprehensive knowledge about such biodegradable polymer may be expected to be present as biodegradable polymer and that it is possible to target different polymers by different enzymes present in the same mixture. Moreover, a significant advantage may be obtained when applying at least two different enzymes due to the fact that the enzymes may be chosen to supplement each other with respect to e.g. the pH- and temperature-intervals in which they are active. In other words, a cleaning agent may be obtained having high activity with respect to the substrate polymer of the chewing gum within a relatively large temperature and pH interval. Thus, the desired acceleration of degradation may be obtained in larger intervals of e.g. temperature and pH compared to what may be obtained e.g. by one single enzyme only.

Concentration of the enzyme in the mixture may vary significantly depending e.g. on the targeted biodegradable polymer(s) and also on the desired efficiency of the cleaning process.

Thus, the concentration of the enzymes in the cleaning agent may be within the range of 0.0001 wt % to 70 wt % of the cleaning agent, although it may typically be preferred in some applications to have a concentration of enzyme in the cleaning agent of less than 10 wt % of the cleaning agent or even lower.

Suitable enzymes for the cleaning agent has been mentioned above.

The cleaning agent may also further comprise detergents such as anionic, cationic, nonionic, or amphoteric surfactants. Further ingredients in the cleaning agent may comprise organic solvents, water, acids, bases, emulsifiers, pH regulating buffers, etc.

Finally, it should be noted that the cleaning agent may comprise a cleaning agent comprising enzyme(s), where both the cleaning agent and/or the enzyme are present in a solid state. Typically, the desired initiation of degradation may however be accelerated by a liquid, such as water, be active or passive adding. Passive adding may e.g. simply be obtained in outdoor environments if it is raining.

FIG. 1*a-d* illustrate the basic principle of how to clean a surface with respect to chewing gum according to different embodiments of the invention.

FIG. 1*a* illustrates the cross-section of a chewing gum lump 2 attached to a surface (not shown). The surface of the chewing gum lump comprises a free surface 6 and a contact surface 7. The contact surface 7 forms part of an interface region, which will be described below. The contact surface 7 is at least partly inaccessible in the sense that the chewing gum lump 2 is covering the contact surface at the one side and the surface 1 (shown in FIG. 1*b*) is covering from the other side.

This principle applies generally to chewing gum lumps attached to surfaces by sticking irrespective of the nature of the surface 1 to which the lump 2 is attached. It is however noted that a relatively smooth surface 1 typically results in a continuous and relatively planar contact over the complete contact surface 7, whereas a relatively discontinues or porous surface 1 results in a substantially corresponding description of the contact region 7 now however with the difference that parts of the contact area 7 is accessible via channels or access-volunes of the surface 1. In other words, parts of the illustrated contact area 7 may actually form a non-continuous part of the free surface 6 in spite of the fact that the illustrated surfaces 6 and 7 are formed as two distinct and continuous surfaces.

In FIG. 1*b* the chewing gum lump 2 of FIG. 1*a* is shown as attached to a surface 1. The chewing gum lump 2 is attached to the surface 1 by means of forces generally referred to as intermolecular forces present in an interface region 4 between the chewing gum lump 2 and the surface. The nature of these intermolecular forces may vary significantly depending on e.g. the nature and structure of the surface and moreover depending on the stickiness of the chewing gum lump 2.

Thus, the interface region 4 may thus be relatively "flat" if the surface 1 is very smooth, e.g. when the surface comprises glass, certain ceramics, polished steel, polished granite, etc.

On the other hand, the interface region 4 may increase significantly in volume if the surface 1 is highly irregular, e.g. when the surface comprises certain types of concrete, asphalt, different bricks, fabrics, clothing, fibrous structures, etc.

The invention is very advantageous when dealing with both types of structures, which will be explained with reference to the following figures.

In FIG. 1*b* a cleaning agent according to the invention is provided to the free surface 6 of the chewing gum lump 2 as indicated by the arrows 3. The cleaning agent comprises at least one enzyme matching at least one polymer present in the chewing gum lump 2 in the sense that the chewing gum lump 1 comprises at least one biodegradable polymer having unstable bonds and that the enzyme facilitates accelerated degradation of the polymer.

In FIG. 1*c* the enzyme is entering the structure of the chewing gum lump 2 via the free surface 6. It is noted that parts of the interface region 4 may actually form part of a free surface 6 as described above although the illustrated embodiment has a very clear and continuous distinction between the free surface 6 and the contact area 7.

The enzyme may be transported through the chewing gum lump 2 or it may invoke a chain-reaction resulting in a degradation of the polymer or polymers targeted by the applied enzyme. Typically, a combined process of direct and indirect access to the internal of the chewing gum lump 2 is preferred. An indirect access may e.g. be facilitated by fillers forming ducts within the chewing gum lump or e.g. through an aqueous transport within the structure if the polymers of the chewing gum are at least partly hydrophilic.

In FIG. 1*d* the reaction has reached the critical interface region 4 and a final releasing of the chewing gum lump 2 may be initiated. It is here noted that the cleaning according to the embodiment of the invention is obtained through active access to the interface region via the free surface 6, which typically forms a relatively difficult obstacle and therefore acts as a protective shield to external attempts to reach the interface region 4.

Finally the chewing gum lump 2 may e.g. dissolve or disintegrate and thereby be removed from the surface. Alternatively, the interface region 4 is targeted more specifically from the sides and the chewing gum lump 2 may release. In other words, under some conditions the resulting effect of the applied enzyme may rather result in a more specific weakening of the intermolecular forces in the interface region 4, thereby invoking that the chewing gum lump may release or be released from the surface 1. In other words, in such case the desired reaction may be obtained primarily in the interface region, i.e. by the transport or reaction indicated by arrows 5. The weakening of the intermolecular adhesive forces in the interface region 4 is according to a preferred embodiment of the invention based on the activity of the applied enzymes, whereby chemical bonds in the biodegradable polymers are broken at an accelerated rate. The accelerated breaking of unstable bonds in the polymers leads to extensive cleaving of polymer molecules, thereby changing their molecular structure and the resulting intermolecular adhesive forces attaching the chewing gum to the surface (1).

According to a preferred embodiment of the invention, the activity of the applied enzymes leads to the breaking of chemical bonds associated with the biodegradable polymers at an accelerated rate, which again leads to a weakening of the intermolecular adhesive forces in the interface region 4. The accelerated breaking of unstable bonds in the polymers may lead to extensive cleaving of polymer molecules, thereby changing their molecular structure and affecting the resulting intermolecular adhesive forces to weaken. Thus, the attachment, e.g. the adhesion to the surface (1) may be become so weak that the chewing gum is readily cleaned off.

It is furthermore noted that the cleaning process as illustrated and explained above feature a targeted cleaning attack to the chewing gum and a very lenient approach to the surface 1. This is in particular beneficial when dealing with complicated surfaces as different as for example clothing and marble, which may typically react very fragile to e.g. acids.

Basically, it is noted in the initial step, that the surface, which need to be cleaned has been applied with one or several chewing gum lumps. An important feature of the applied chewing gum is that the lumps actually stick to the surface and that chewing gum comprises at least one biodegradable polymer.

Evidently the illustrated process may be supplemented by further cleaning process steps such as heating, adding of aqueous detergents, etc.

Generally, the applied enzymes of the cleaning agent should match the intended substrate, i.e. the biodegradable chewing gum polymer(s). The general functionality and interacting between enzymes and chewing gum comprising biodegradable polymer(s) is described in PCT/DK2003/000939, hereby incorporated by reference.

It should also be noted, as also described in PCT/DK2003/000939, that an amount of enzyme may be added to the chewing gum itself in order to improve the overall reaction rate.

FIG. 2 illustrates different principle process steps according to the invention.

Step 21 involves generally that a chewing gum lump is attached to a surface. Evidently, the attaching of chewing gum to a surface may involve attachment of several chewing gum lumps to the surface, and the attachment process is performed over a time period e.g. stretching over hours or days. In other words, the attached chewing gum lumps may be subject to different environmental conditions with respect to e.g. temperature and humidity and the lumps may also be subject to different mechanical stress e.g. originating from pressure invoked by footsteps. Thus, the degree of attachment of the different chewing gum lumps may differ significantly.

Step 22, which is optional, involves a preconditioning, which may e.g. involve use of conventional cleaning methods involving e.g. the use of heat, application of different chemical substances, application of UV light, application of steam, etc. All these methods, well-known within the art may e.g. be performed by means of known methods or known apparatuses adapted for the purpose. One pre-conditioning according to an embodiment of the invention is on the other hand quite uniquely related to the principles of the invention, namely adjustment of the temperature of the chewing gum lumps, e.g. by heating, to match the desired optimal temperatures related to the function of the intended enzymes with respect the chewing gum polymer(s). In other words, the chewing gum lumps may advantageously be heated to a temperature at which an enzyme contained in the cleaning agent has the best effect with respect to degradability of the polymers chains.

Step 23, which is mandatory, involves the application of a cleaning agent comprising enzymes, which may interact with all or some of the polymers of the chewing gum lump(s). Thus, an active targeting of one or more biodegradable chewing gum lumps is obtained. Evidently, the most efficient targeting may be obtained when targeting chewing gum lumps comprising biodegradable polymers only. Step 23 may e.g. be performed manually in conventional cleaning manner, e.g. by means of a cloth soaked with a cleaning agent comprising an enzyme-holding aqueous solution or emulsion. Alternatively, step 23 may be performed by means of dedicated equipment for the purpose of optimizing the desired reaction. Thus, such equipment may involve an apparatus adapted for establishment of a desired temperature of the applied cleaning agent. The desired temperature may e.g. match the intended or optimal temperature related to the reaction between the polymer of the chewing gum and the enzyme, or it may e.g. counteract the environmental temperature by increasing the temperature of the cleaning agent to a certain degree if the environmental temperature is lower than the preferred interaction temperature. Evidently, such control of temperature should ensure that the applied enzymes are not destroyed.

Step 24, which is optional, may again be applied for the purpose of e.g. obtaining a desired humidity or temperature subsequent to the application of the cleaning agent.

Finally, the addressed chewing gum lumps may either be cleaned from the surface by means of a complete disintegration or simply by reducing the intermolecular forces in the interface region between the chewing gum lump and the surface sufficiently so the chewing gum lump may be deattached and removed from the surface. This is in particular the case when applying chewing gum where the gum base only partly comprises biodegradable polymers.

FIGS. 3*a* to 3*d* illustrate a further example of the effect according to an embodiment of the invention of applying enzymes to a chewing gum lump using a cleaning agent as vehicle for the enzymes.

Figure 3A:
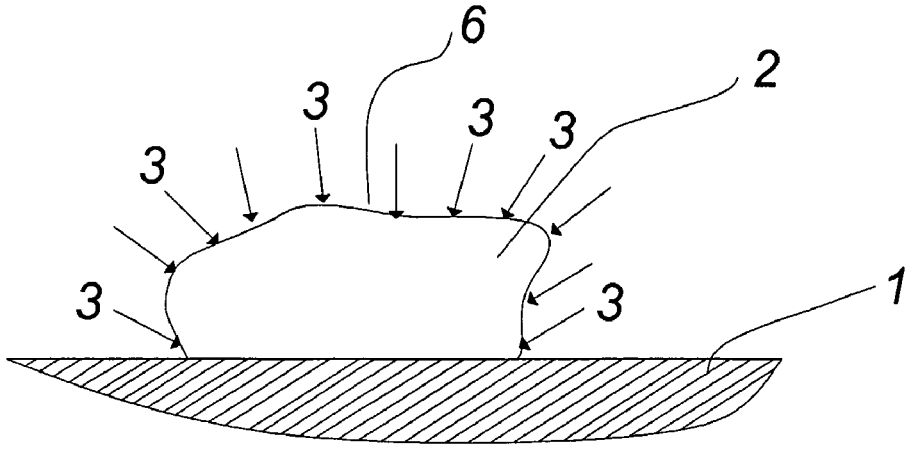
Figure 3B:
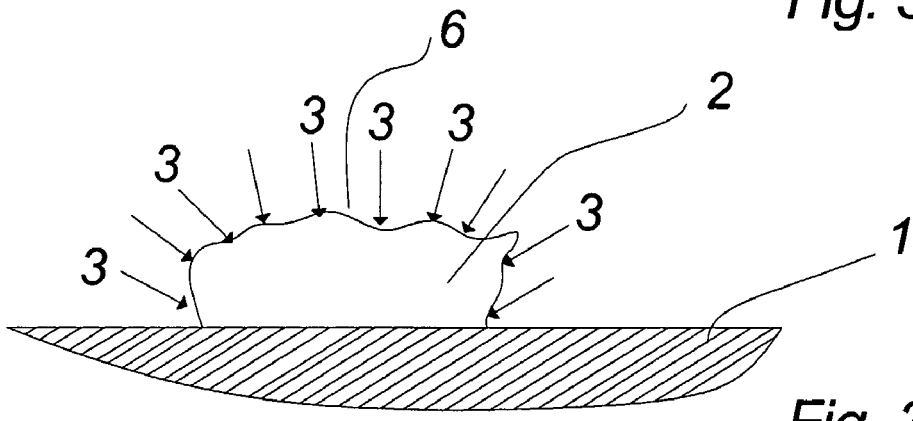

In FIG. 3*a*, a chewing gum lump 2 is illustrated as attached and adhered to a surface 1, while cleaning agent 3 is applied onto the free surface 6 of the chewing gum lump. In FIG. 3*b* an intermediate result of application of cleaning agent 3 is illustrated, as the chewing gum lump is noticeably reduced in size. The chewing gum lump has been partly cleaned off by way of the cleaning agent 3, which among other cleaning effects has accelerated the degradation of the polymer molecules considerably by means of the applied enzymes.

Figure 3C:
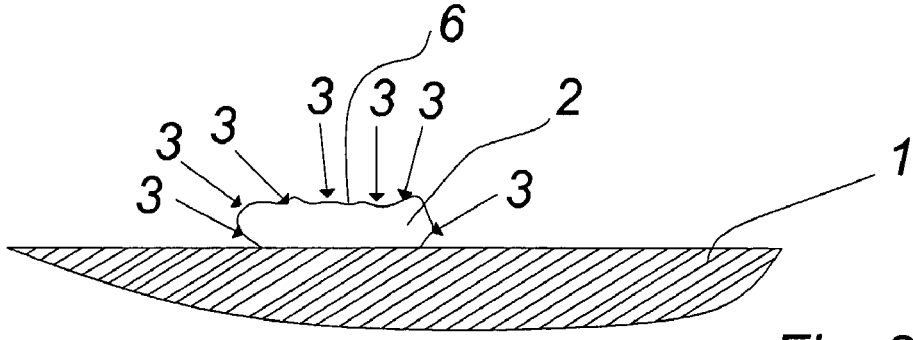

In FIG. 3*c* only a small part of the chewing gum lump is left. The main part of the chewing gum lump has been cleaned off as a result of the cleaning agent 3 and in particular the enzymatic degradation, which has accelerated the breaking of chemical bonds such as e.g. ester bonds in the biodegradable chewing gum polymers.

Figure 3D:
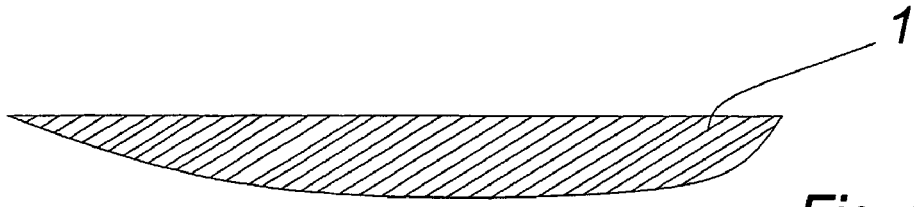

FIG. 3*d* illustrates that the chewing gum lump has been completely cleaned off by way of the cleaning agent, and in particular by way of the enzymatic degradation of the biodegradable polymers. The enzymes have accelerated the degradation reaction and thus broken down the polymer molecules to smaller degradation products, which have easily been cleaned off.

The Chewing Gum

Unless otherwise indicated, as used herein with regard to polymers, the term "molecular weight" means number average molecular weight (Mn) in g/mol. The short form PD designates the polydispersity. Likewise the molecular weight of enzymes is given in kilodaltons, abbreviated kDa.

The glass transition temperature ($T_g$) may be determined by for example DSC (DSC: differential scanning calorimetry). The DSC may generally be applied for determining and studying of the thermal transitions of a polymer and specifically, the technique may be applied for the determination of a second order transition of a material, i.e. a thermal transition that involves a change in heat capacity, but does not have a latent heat. The glass transition is a second-order transition.

The following non-limiting examples illustrate the manufacturing of a chewing gum according to the invention.

EXAMPLE 1

Preparation of Polyester Elastomer Obtained by Ring-Opening Polymerization

An elastomer sample is synthesized within a dry $N_2$ glove box, as follows. Into a 500 mL resin kettle equipped with overhead mechanical stirrer, 3.143 g pentaerythritol and 0.5752 g $Sn(Oct)_2$ (2.0 ml of a 1.442 gSn(Oct)2/5 mL in methylene chloride) are charged under dry $N_2$ gas purge. The methylene chloride is allowed to evaporate under the $N_2$ purge for 15 min. Then ϵ-caprolactone (1144 g, 10 mol), Trimethylene carbonate (31 g, 0.30 mol) and δ-valerolactone (509 g, 5.1 mol) are added. The resin kettle is submerged in a 130° C. constant temperature oil bath and stirred for 13.9 h. Subsequently the kettle is removed from the oil bath and allowed to cool at room temperature. The solid, elastic product is removed in small pieces using a knife, and placed into a plastic container.

Characterization of the product indicates $M_n$=56,000 g/mol and $M_w$=98,700 g/mol (gel permeation chromatography with online MALLS detector). And Tg=−58.9° C. (DSC, heating rate 10° C./min).

EXAMPLE 2

Preparation of Polyester Elastomer Obtained by Ring-Opening Polymerization

An elastomer sample is synthesized within a dry $N_2$ glove box, as follows. Into a 500 mL resin kettle equipped with overhead mechanical stirrer, 3.152 g pentaerythritol and 0.5768 g $Sn(Oct)_2$ (2.0 ml of a 1.442 gSn(Oct)2/5 mL in methylene chloride) are charged under dry $N_2$ gas purge. The methylene chloride is allowed to evaporate under the $N_2$ purge for 15 min. Then ϵ-caprolactone (1148 g, 10 mol), Trimethylene carbonate (31 g, 0.30 mol) and δ-valerolactone (511 g, 5.1 mol) are added. The resin kettle is submerged in a 130° C. constant temperature oil bath and stirred for 13.4 h. Subsequently the kettle is removed from the oil bath and allowed to cool at room temperature. The solid, elastic product is removed in small pieces using a knife, and placed into a plastic container.

Characterization of the product indicates $M_n$=88,800 g/mol and $M_w$=297,000 g/mol (gel permeation chromatography with online MALLS detector). And Tg=−59.4° C. (DSC, heating rate 10° C./min).

EXAMPLE 3

Preparation of Polyester Resin Obtained by Ring-Opening Polymerization

A resin sample is produced using a cylindrical glass, jacketed 10 L pilot reactor equipped with glass stir shaft and Teflon stir blades and bottom outlet. Heating of the reactor contents is accomplished by circulation of silicone oil, thermo stated to 130° C., through the outer jacket. ϵ-caprolactone (358.87 g, 3.145 mol) and 1,2-propylene glycol (79.87 g, 1.050 mol) are charged to the reactor together with stannous octoate (1.79 g, $4.42\times10^{-3}$ mol) as the catalyst and reacting in about 30 min. at 130° C. Then molten D,L-lactide (4.877 kg, 33.84 mol) are added and reaction continued for about 2 hours. At the end of this period, the bottom outlet is opened, and molten polymer is allowed to drain into a Teflon-lined paint can.

Characterization of the product indicates $M_n$=6,000 g/mol and $M_w$=7,000 g/mol (gel permeation chromatography with online MALLS detector) and Tg=25-30° C. (DSC, heating rate 10° C./min).

EXAMPLE 4

Preparation of Polyester Elastomer Obtained by Step-Growth Polymerization

An elastomer sample is produced using a 500 mL resin kettle equipped with an overhead stirrer, nitrogen gas inlet tube, thermometer, and distillation head for removal of methanol. To the kettle are charged 83.50 g (0.43 mole) dimethyl terephthalate, 99.29 g (0.57 mole) dimethyl adipate, 106.60 g (1.005 mole) di(ethylene glycol) and 0.6 g calcium acetate monohydrate. Under nitrogen, the mixture is slowly heated with stirring until all components become molten (120-140° C.). Heating and stirring are continued and methanol is continuously distilled. The temperature slowly rises in the range 150-200° C. until the evolution of methanol ceases. Heating is discontinued and the content is allowed to cool to about 100° C. The reactor lid is removed and the molten polymer is carefully poured into a receiving vessel.

Characterization of the product indicates $M_n$=40,000 g/mol and $M_w$=190,000 g/mol (gel permeation chromatography with online MALLS detector) and $T_g$=−30° C. (DSC, heating rate 10° C./min).

EXAMPLE 5

Preparation of Gum Bases

The process of preparing gum bases is carried out in the following way: The elastomer and resin are added to a mixing kettle provided with mixing means like e.g. horizontally placed Z-shaped arms. The kettle has been preheated for 15 minutes to a temperature of about 60-80° C. The mixture is mixed for 10-20 minutes until the whole mixture becomes homogeneous. The mixture is then discharged into the pan and allowed to cool to room temperature from the discharged temperature of 60-80° C.

Two different gum bases as shown in table 1 were prepared.

TABLE 1

Gum base preparation.

| Gum base No. | Resin | Elastomer1 | Elastomer2 | Ratio of resin/elastomer1/elastomer2 |
|---|---|---|---|---|
| 101 | Resin polymer of example 3 | Elastomer polymer of example 1 | Elastomer polymer of example 2 | 55/30/15 |
| 102 | Resin polymer of example 3 | Elastomer polymer of example 4 | — | 60/40 |

EXAMPLE 6

Preparation of Chewing Gum

The gum bases of example 5 were used in the preparation of chewing gum with the basic formulations shown in table 2.

TABLE 2

Chewing gum formulations.

| Ingredients | Formulation No. 1000 | Formulation No. 1001 |
|---|---|---|
| Sorbitol | 44.6 | 44.6 |
| Gum base | 32.0 | 32.0 |
| Lycasin | 3.0 | 3.0 |
| Peppermint oil | 1.5 | 1.5 |
| Menthol crystals | 0.5 | 0.5 |
| Aspartame | 0.2 | 0.2 |
| Acesulfame | 0.2 | 0.2 |
| Xylitol | 6.0 | 6.0 |
| Wax | 4.0 | 4.0 |
| Triacetine | 2.0 | 2.0 |
| Emulsifiers | 1.0 | 1.0 |
| Talcum (Fillers) | 5.0 | 5.0 |

Ingredients concentrations are given in percent by weight.

The softeners, emulsifiers and fillers may alternatively be added to the polymers as a part of the gum base preparation.

The gum bases of example 5 were used with the chewing gum formulations of table 2 and the following chewing gum samples were prepared:

TABLE 3

Chewing gum samples with different gum bases.

| Gum base ref. | Formulation ref. |
|---|---|
| 101 | 1000 |
| 102 | 1001 |

The chewing gum products are prepared as follows:

The gum base is added to a mixing kettle provided with mixing means like e.g. horizontally placed Z-shaped arms. The kettle has been preheated for 15 minutes to a temperature of about 60-80° C. or the chewing gum is made in one step, immediately after preparation of gum base in the same mixer where the gum base and kettle has a temperature of about 60-80° C.

One half portion of the sorbitol is added together with the gum base and mixed for 3 minutes. Peppermint and menthol are then added to the kettle and mixed for 1 minute. The remaining half portion of sorbitol is added and mixed for 1 minute. Softeners are slowly added and mixed for 7 minutes. Then aspartame and acesulfame are added to the kettle and mixed for 3 minutes. Xylitol is added and mixed for 3 minutes. The resulting gum mixture is then discharged and e.g. transferred to a pan at a temperature of 40-48° C. The gum is then rolled and cut into cores, sticks, balls, cubes, and any other desired shape, optionally followed by coating and polishing processes prior to packaging or use. Evidently, within the scope of the invention, other processes and ingredients may be applied in the process of manufacturing the chewing gum, for instance the one-step method may be a lenient alternative.

The Cleaning Agent

EXAMPLE 7

Preparation of Cleaning Agent

The applied cleaning agent comprised aqueous solutions of four different enzymes. The applied enzymes were purchased from companies located in Denmark: Antra ApS (Bromelain, product name Bromelin), Novozymes (Neutrase and Trypsin, product names Neutrase 0.8 L and Pancreatic Trypsin Novo 6.0 S, Type Saltfree) and Danisco Cultor (Glucose oxidase, product name TS-E 760). The enzymes Bromelain, Neutrase and Glucose oxidase were available as powders and the enzyme Trypsin as a liquid.

A first cleaning agent CA1 comprises 25 g Trypsin and 25 g of Bromelain mixed in 100 ml of water.

A second cleaning agent CA2 comprises 25 g of Neutrase mixed in 100 ml of water.

A third cleaning agent CA3 comprises 25 g of Glucose mixed in 100 ml of water.

TABLE 4

Cleaning agents with different types of enzyme.

| Cleaning agent No. | Enzyme content in aquous mixture [%] | Enzyme |
|---|---|---|
| CA1 | 33% | Trypsin + Bromelain |
| CA2 | 20% | Neutrase |
| CA3 | 20% | Glucose oxidase |

EXAMPLE 8

Evaluation of Cleaning Effect

A test setup was prepared for the evaluation a cleaning method according to the invention.

12 chewed chewing gum lumps of the formulation 1000 were prepared by means of a chewing machine. The chewing gum lumps were chewed in 10 minutes.

12 more chewed chewing gum lumps of the formulation 1001 were prepared by means of a chewing machine. The Chewing gum lumps were chewed in 20 minutes.

Each of three ceramic surfaces were attached with four chewing chewing gum lumps having the formulation 1000 and four chewed chewing gum lumps having formulation 1001.

Each of the ceramic surfaces were treated with cleaning agents in a similar manner; one of the lumps having formulation 1000 were treated with cleaning agent CA1, one of the lumps having formulation 1000 were treated with cleaning agent CA2, one of the lumps having formulation 1000 were treated with cleaning agent CA3 and one were left untreated. Moreover one of the lumps having formulation 1001 were treated with cleaning agent CA1, one of the lumps having formulation 1001 were treated with cleaning agent CA2, one of the lumps having formulation 1001 were treated with cleaning agent CA3 and one were left untreated.

The three ceramic surfaces were then stored in 0° C., 20° C. and 40° C., respectively, in a four day period.

At 20° C. was observed substantial reaction of the treated samples. Initial detachment in the circumference of the lump was observed and the lumps were crumbling.

At 40° C. was observed substantial reaction of the treated samples. Bubbles were observed within the chewing gum lump after one day. Initial detachment in the circumference of the lump was observed and the lumps were crumbling.

The invention claimed is:

1. Method of cleaning a surface attached with at least one chewing gum lump whereby said cleaning is at least partly based on an enzymatic degradation of at least one biodegradable polymer in said chewing gum lump and whereby said enzymatic degradation is established by the application of a cleaning agent comprising at least one enzyme to which said at least one polymer forms substrate and whereby said cleaning agent comprising said at least one enzyme is added to said chewing gum lump subsequent to chewing and attachment of said chewing gum lump to said surface, wherein said cleaning agent comprises at least one enzyme in a liquid suspension or solution, wherein a concentration of said at least one enzyme is in the range of 0.0001 wt % to 70 wt % of the cleaning agent, wherein at least one of said at least one enzyme is selected from the group consisting of oxidoreductases, transferases, hydrolases, lyases, isomerases, ligases, lipases, esterases, depolymerases, peptidases and proteases, wherein at least one of said at least one enzyme has a molecular weight of 2 to 1000 kDa, and wherein said at least one enzyme is transported through the chewing gum lump or is invoking a chain-reaction resulting in a degradation of the polymer or polymers targeted by the applied enzyme.

2. Method of cleaning a surface according to claim 1, whereby said enzymatic degradation is supplemented by a further enzymatic degradation obtained through enzymes present in the chewing gum lump during chewing.

3. Method of cleaning a surface according to claim 1, said chewing gum lump being attached to said surface by means of intermolecular forces in a contact area, said chewing gum lump comprising at least one biodegradable polymer, said biodegradable polymer having unstable bonds and forming substrate to at least one enzyme, reducing the intermolecular forces in an interface region by modifying the structure of the molecular chains of said polymer by the process of providing said cleaning agent to a free surface of said chewing gum lump, said cleaning agent comprising enzymes to which said biodegradable polymer forms substrate.

4. Method of cleaning a surface according to claim 1, said cleaning agent comprising enzymes in a solid state or mixture.

5. Method of cleaning a surface according to claim 1, wherein said cleaning agent comprises at least one enzyme mixed in water.

6. Method of cleaning a surface according to claim 1, wherein the concentration of said enzymes is in the range of 0.0002 wt % to 10 wt % of the cleaning agent.

7. Method of cleaning a surface according to claim 1, wherein the concentration of said enzymes is in the range of 0.0003 wt % to 5 wt % of the cleaning agent.

8. Method of cleaning a surface according to claim 1, wherein at least two enzymes of said cleaning agent have different active areas with respect to temperature and/or pH.

9. Method of cleaning a surface according to claim 1, wherein an active range of said cleaning agent with respect to temperature or pH is obtained by different enzymes having different active ranges.

10. Method of cleaning a surface according to claim 3, said free surface comprising a part of the surface of the chewing gum, which is not sticking to the surface.

11. Method of cleaning a surface according to claim 3, wherein said reducing of the intermolecular forces involves a complete or at least partly dissolving of the chewing gum lump.

12. Method of cleaning a surface according to claim 3, wherein said reducing of the intermolecular forces involves a complete or at least partly dissolving of the chewing gum lump forming the contact area of the chewing gum.

13. Method of cleaning a surface according to claim 1, said at least one biodegradable polymer being substantially hydrophilic.

14. Method of cleaning a surface according to claim 1, said chewing gum lump being substantially free of non-biodegradable polymers.

15. Method of cleaning a surface according to claim 1, said polymer comprising an elastomer.

16. Method of cleaning a surface according to claim 1, wherein at least one of said at least one biodegradable polymer comprises at least one polyester polymer obtainable by polymerization of at least one cyclic ester.

17. Method of cleaning a surface according to claim 1, wherein at least one of said at least one biodegradable polymer comprises at least one polyester polymer obtainable by condensation polymerization of at least one polyfunctional alcohol or derivative thereof and at least one polyfunctional acid or derivative thereof.

18. Method of cleaning a surface according to claim 1, wherein at least one of said at least one biodegradable polymer comprises at least one polyester obtainable by polymerization of at least one compound selected from the group consisting of cyclic esters, alcohols or derivatives thereof and carboxylic acids or derivatives thereof.

19. Method of cleaning a surface according to claim 17, wherein at least one of said at least one polyfunctional alcohol is a polyhydroxy alkyl alcohol.

20. Method of cleaning a surface according to claim 17, wherein said derivative of said at least one polyfunctional alcohol comprises an ester of an alcohol.

21. Method of cleaning a surface according to claim 17, wherein at least one of said at least one polyfunctional acid is a hydroxycarboxylic acid.

22. Method of cleaning a surface according to claim 17, wherein at least one of said at least one polyfunctional acid is an α-hydroxy acid selected from the group consisting of lactic acids and glycolic acids.

23. Method of cleaning a surface according to claim 17, wherein said derivative of said at least one polyfunctional acid is selected from the group of esters, anhydrides or halides of carboxylic acids.

24. Method of cleaning a surface according to claim 17, wherein said derivative of said at least one polyfunctional acid is selected from methyl esters or ethyl esters of carboxylic acids.

25. Method of cleaning a surface according to claim 17, wherein said polyester is obtainable through reaction of at least one acid or derivative thereof selected from the group of terephthalic, phthalic, adipic, pimelic, succinic, malonic acids or combinations thereof with at least one alcohol or derivative thereof selected from the groups of methylene, ethylene, propylene, butylene diols or combinations thereof.

26. Method of cleaning a surface according to claim 16, wherein at least one of said at least one cyclic ester is selected from the group of monomers comprising glycolides, lactides, lactones, cyclic carbonates or mixtures thereof.

27. Method of cleaning a surface according to claim 26, wherein at least one of said lactone monomers is selected from the group of ϵ-caprolactone, δ-valerolactone, γ-butyrolactone, and β-propiolactone, including ϵ-caprolactones, δ-valerolactones, γ-butyrolactones, or β-propiolactones that have been substituted with one or more alkyl or aryl substituents at any non-carbonyl carbon atoms along the ring, including compounds in which two substituents are contained on the same carbon atom.

28. Method of cleaning a surface according to claim 26, wherein at least one of said carbonate monomers is selected from the group consisting of trimethylene carbonate, 5-alkyl-1,3-dioxan-2-one, 5,5-dialkyl-1,3-dioxan-2-one, 5-alkyl-5-alkyloxycarbonyl-1,3-dioxan-2-one, ethylene carbonate, propylene carbonate, trimethylolpropane monocarbonate, 4,6-dimethyl-1,3-propylene carbonate, 2,2-dimethyl trimethylene carbonate, 1,3-dioxepan-2-one and mixtures thereof.

29. Method of cleaning a surface according to claim 16, wherein said at least one polyester polymer obtainable by polymerization of at least one cyclic ester is selected from the group consisting of poly (L-lactide); poly (D-lactide); poly (D, L-lactide); poly (mesolactide); poly (glycolide); poly (trimethylenecarbonate); poly (epsilon-caprolactone); poly (L-lactide-co-D, L-lactide); poly (L-lactide-co-meso-lactide); poly (L-lactide-co-glycolide); poly (L-lactide-co-trimethylenecarbonate); poly (L-lactide-co-epsilon-caprolactone); poly (D, L-lactide-co-meso-lactide); poly (D, L-lactide-co-glycolide); poly (D, L-lactide-co-trimethylenecarbonate); poly (D, L-lactide-co-epsilon-caprolactone); poly (meso-lactide-co-glycolide); poly (meso-lactide-co-trimethylenecarbonate); poly (meso-lactide-co-epsilon-caprolactone); poly (glycolide-cotrimethylenecarbonate); and poly (glycolide-co-epsilon-caprolactone).

30. Method of cleaning a surface according to claim 17, wherein said polyester is produced through a reaction of multifunctional alcohol and at least one acid chosen from the group consisting of citric acid, malic acid, fumaric acid, adipic acid, succinic acid, suberic acid, sebacic acid, dodecanedioic acid, glucaric acid, glutamic acid, glutaric acid, azelaic acid, and tartaric acid.

31. Method of cleaning a surface according to claim 1, wherein said biodegradable polymer comprises polyurethane.

32. Method of cleaning a surface according to claim 1, wherein said biodegradable polymer comprises polyhydroxyalkanoates.

33. Method of cleaning a surface according to claim 16, wherein at least one of said enzymes is accelerating the degradation of said polyester obtainable by ring-opening polymerization of at least one cyclic ester.

34. Method of cleaning a surface according to claim 17, wherein at least one of said enzymes is accelerating the degradation of said polyester obtainable by polymerization of at least one alcohol or derivative thereof and at least one acid or derivative thereof.

35. Method of cleaning a surface according to claim 1, wherein at least one of said enzymes is an oxidoreductase.

36. Method of cleaning a surface according to claim 1, wherein at least one of said enzymes is a hydrolase.

37. Method of cleaning a surface according to claim 1, wherein at least one of said enzymes is a lyase.

38. Method of cleaning a surface according to claim 36, wherein at least one of said hydrolase enzymes is acting on ester bonds.

39. Method of cleaning a surface according to claim 36, wherein at least one of said hydrolase enzymes is a glycosylase.

40. Method of cleaning a surface according to claim 36, wherein at least one of said hydrolase enzymes is acting on ether bonds.

41. Method of cleaning a surface according to claim 36, wherein at least one of said hydrolase enzymes is acting on carbon-nitrogen bonds.

42. Method of cleaning a surface according to claim 36, wherein at least one of said hydrolase enzymes is acting on peptide bonds.

43. Method of cleaning a surface according to claim 36, wherein at least one of said hydrolase enzymes is acting on acid anhydrides.

44. Method of cleaning a surface according to claim 36, wherein at least one of said hydrolase enzymes is acting on carbon-carbon bonds.

45. Method of cleaning a surface according to claim 36, wherein at least one of said hydrolase enzymes is acting on halide bonds, phosphorus-nitrogen bonds, sulfur-nitrogen bonds, carbon-phosphorus bonds, sulfur-sulfur bonds, or carbon-sulfur bonds.

46. Method of cleaning a surface according to claim 1, wherein at least one of said enzymes is an endo-enzyme.

47. Method of cleaning a surface according to claim 1, wherein at least one of said enzymes is an exo-enzyme.

48. Method of cleaning a surface according to claim 1, wherein at least two enzymes are combined in said cleaning agent.

49. Method of cleaning a surface according to claim 1, wherein at least one of said enzymes requires a co-factor to carry out its catalyzing function, and wherein the co-factor is provided in the cleaning agent.

50. Method of cleaning a surface according to claim 1, wherein said chewing gum comprises means for facilitating internal transport of enzymes or liquid structures.

51. Method of cleaning a surface according to claim 1, wherein said chewing gum comprises prolamine.

52. Method of cleaning a surface according to claim 51, wherein prolamine has a texturizing agent entrapped therein, produced by solubilizing prolamine and then co-precipitating prolamine with a texturizing agent.

53. Method of cleaning a surface according to claim 51, wherein prolamine is selected from the group consisting of zein, gliadin, horedein and combinations thereof.

54. Method of cleaning a surface according to claim 52, wherein the texturizing agent is a food grade organic acid, food grade mineral acid, an alpha-hydroxy acid, a mono-, di- or tri-carboxylic acid, a Lewis acid salt, a C3-C4 hydroxyalkyl ester of an organic acid, a C2-C5 alkyl ester of an organic acid, a C-C5 alkyl ester of an alpha-hydroxy acid, a salt of an organic acid, a salt of an alpha-hydroxy acid, amino acid, amine salt, polymeric acids and combinations thereof.

55. Method of cleaning a surface according to claim 54, wherein the alpha-hydroxy acid is selected from the group consisting of lactic acid, citric acid, tartaric acid, malic acid and combinations thereof.

56. Method of cleaning a surface according to claim 1, wherein said chewing gum comprises gluten.

57. Method of cleaning a surface according to claim 3, wherein said chewing gum lump facilitates transport or a degradation reaction through the chewing gum towards the interface region.

58. Method of cleaning a surface according to claim 1, comprising providing a cleaning agent to said chewing gum lump, said cleaning agent comprising at least one enzyme and establishing conditions targeting an activation of the at least one enzyme in relation to the at least one biodegradable polymer.

59. Method of cleaning a surface according to claim 58, wherein at least one of said conditions comprises a temperature control of said cleaning agent or said at least one enzyme.

60. Method of cleaning a surface according to claim 58, wherein at least one of said conditions comprises humidity in the near vicinity of said chewing gum lump.

61. Method of cleaning a surface according to claim 58, comprising controlling said conditions in a time period subsequent to said activation.

62. Method of cleaning a surface according to claim 58, comprising controlling said conditions in at least 5 seconds subsequent to said activation.

63. Method of cleaning a surface according to claim 58, wherein said activation is performed simultaneous to said providing of a cleaning agent.

64. Method of cleaning a surface according to claim 58, whereby said activation is followed or initiated by a preconditioning of said chewing gum lump by means of physical parameters.

65. Method of cleaning a surface according to claim 1, whereby said enzymes comprise at least two different types of enzymes.

* * * * *